United States Patent [19]

Okamura

[11] Patent Number: 4,899,632

[45] Date of Patent: Feb. 13, 1990

[54] MULTI-RECORDING APPARATUS OF AN ELECTRONIC MUSICAL INSTRUMENT

[75] Inventor: Kazuhisa Okamura, Hamamatsu, Japan

[73] Assignee: Yamaha Corporation, Hamamatsu, Japan

[21] Appl. No.: 153,333

[22] Filed: Feb. 8, 1988

[30] Foreign Application Priority Data

Feb. 6, 1987 [JP] Japan ..... 62-24866
Feb. 6, 1987 [JP] Japan ..... 62-24867
Feb. 6, 1987 [JP] Japan ..... 62-24865

[51] Int. Cl.[4] ..... G10F 1/00; G10H 1/00; G10H 3/03

[52] U.S. Cl. ..... 84/601; 84/622

[58] Field of Search ..... 84/1.01, 1.03, 1.28, 84/462, DIG. 12, DIG. 29; 364/900, 419

[56] References Cited

U.S. PATENT DOCUMENTS 3,755,608 8/1973 Deutsch ..... 84/1.28 X
4,176,578 9/1979 Campbell et al. ..... 84/DIG. 29
4,307,645 12/1982 Uchiyama ..... 84/1.03 X
4,348,928 9/1982 Sakashita et al. ..... 84/1.01
4,448,104 5/1984 Hoshii ..... 84/1.03 X
4,546,687 10/1985 Minami ..... 84/1.28
4,694,724 9/1987 Kikumoto et al. ..... 84/DIG. 29
4,742,748 5/1988 Tateishi ..... 84/1.28 X
4,754,680 5/1988 Morikawa et al. ..... 84/1.28 X
4,785,707 11/1988 Suzuki ..... 84/1.28 X
4,788,896 12/1988 Uchiyama et al. ..... 84/1.01
4,805,509 2/1989 Matsuda ..... 84/1.28 X
4,833,962 5/1989 Mazzola et al. ..... 84/1.01

*Primary Examiner*—Arthur T. Grimley
*Assistant Examiner*—Matthew S. Smith
*Attorney, Agent, or Firm*—Spensley Horn Jubas & Lubitz

[57] ABSTRACT

The multi-recording apparatus of an electronic musical instrument pre-records performance information designated by event data representative of events of depressed or released keys and generation timings of the events. The performance information is recorded in a memory having a plurality of channels. When newly inputted performance information is supplied from the electronic musical instrument to this multi-recording apparatus in a recording mode, the pre-recorded performance information is reproduced from a selected channel, so that a player can listen to musical tones corresponding to the pre-recorded performance information. At the same time, the newly inputted performance information is over-recorded with the pre-recorded performance information on the same selected channel, whereby a multi-recording can be done.

11 Claims, 16 Drawing Sheets

(OPERATION EXAMPLE OF MULTI-RECORDING)

| I/O / TRACK NO. | INPUT | | OUTPUT | | TRACK MODE |
|---|---|---|---|---|---|
| | TERMINAL | CHANNEL | TERMINAL | CHANNEL | |
| 0 | 2 | 1 | 3 | 11 | 0 (STOP) |
| 1 | 1 | 6 | 1 | 6 | 1 (PLAY) |
| ⋮ | | | | | |
| 63 | 1 | 6 | 2 | 5 | 2 (REC) |

| TRACK MODE / JOB | 0 (STOP) | 1 (PLAY) | 2 (REC) |
|---|---|---|---|
| 0 (STOP) | — | — | OUTPUT |
| 1 (PLAY) | — | — | OUTPUT |
| 2 (REC) | — | — | OUTPUT & RECORD |

| TRACK MODE / JOB | 0 (STOP) | 1 (PLAY) | 2 (REC) |
|---|---|---|---|
| 0 (STOP) | — | — | — |
| 1 (PLAY) | — | OUTPUT | OUTPUT |
| 2 (REC) | — | OUTPUT | OUTPUT |

(UP/DOWN SWITCHING PROCESS)

(LEFT/RIGHT SWITCHING PROCESS)

(REC SWITCH-ON PROCESS)

(PLAY SWITCH-ON PROCESS)

OLD SEQUENCE DATA (a) $K_1$ 8 $K_2$ 5 $K_3$ 250 $K_4$ 10

NEW SEQUENCE DATA (b) $K_1$ 5 $K_A$ 3 $K_2$ 5 $K_3$ 244 $K_B$ 6 $K_4$

| | PLAYTIMER | RECTIMER | RECCNT | LNSAM | LNREST | LEN | WRITE |
|---|---|---|---|---|---|---|---|
| $K_1$ | 8 SET | 0 | 0 | 0 | 8 | | $K_1$ |
| | 7 | 1 | | | | | |
| | 6 | 2 | | | | | |
| | 5 | 3 | | | | | |
| | 4 | 4 | | | | | |
| $K_A$ ⇒ (INPUTIRQ) | 3 | 5 | 5 | 0 (RESET) | 3 | 5 | 5, $K_A$ |
| | 2 | 6 | | | | | |
| | 1 | 7 | | | | | |
| $K_2$ | 0 = 5 (PLAYIRQ) | 8 | 8 | 0 (RESET) | 5 | 3 | 3, $K_2$ |
| | 4 | 9 | | | | | |
| | 3 | 10 | | | | | |
| | 2 | 11 | | | | | |
| | 1 | 12 | | | | | |
| $K_3$ | 0 ⇒ 250 (PLAYIRQ) | 13 | 13 | 0 (RESET) | 250 | 5 | 5, $K_3$ |
| | 249 | 14 | | | | | |
| | 9 | 254 | | | | | |
| | 8 | 255 | | | | | |
| | 7 | 0 (REC IRQ) | 0 (RESET) | 243 | | | |
| $K_B$ ⇒ (INPUTIRQ) | 6 | 1 | 1 | 0 (RESET) | 6 | 244 | 244, $K_B$ |
| $K_4$ | 0 ⇒ 10 (PLAYIRQ) | 7 | 7 | 0 (RESET) | 10 | 6 | 6, $K_4$ |

(OPERATION EXAMPLE OF MULTI-RECORDING)

FIG.27

MULTI-RECORDING APPARATUS OF AN ELECTRONIC MUSICAL INSTRUMENT

BACKGROUND OF THE INVENTION

The present invention generally relates to a recording apparatus for recording musical tones generated by an electronic musical instrument which is played based on performance information inputted from a keyboard or a computer, and more particularly to a multi-recording apparatus capable of multi-recording inputted musical tones in addition to pre-recorded musical tones.

Conventionally, an automatic performance apparatus as disclosed in Japanese Patent Application Laid-Open No. 58-211191 is known as a conventional performance recording and reproducing apparatus. This conventional apparatus provides a performance data memory for storing key data representative of the depressed keys, key event timing data representative of key-on and key-off timings of each key and tone generating channel data representative of a channel of a tone generating circuit, whereby a musical tone having a different tone color can be recorded on and reproduced from each channel.

However, the above conventional apparatus is merely a performance recording apparatus, hence, the conventional apparatus is disadvantageous in that the conventional apparatus can not record new musical tones on a pre-recorded channel while reproducing the pre-recorded musical tones. More specifically, the conventional apparatus can record performance information on plural recording channels based on a time-division system, and the conventional apparatus can simultaneously reproduce the recorded performance information from such plural recording channels. However, the conventional apparatus can not perform a real multi-recording. More specifically, the conventional apparatus can not record newly inputted information on the pre-recorded channel while reproducing pre-recorded information from such pre-recorded channel. By increasing a channel number, it is possible to obtain an advantage similar to that of the multi-recording. However, there are many restrictions concerning information quantity (such as the channel number) and the like. Hence, it is difficult to increase the channel number.

In the case where the information is recorded on a nonrecorded channel in the conventional apparatus, the information of the pre-recorded channel is read from a desirable bank of a memory, and then the read information is reformed with the inputted performance data. Such reformed information is temporarily written into the non-recorded channel, and then such reformed information is transferred to the original bank at a time when a recording mode is completed. In this case, timing data after the above-mentioned reformation are calculated out based on a clock value at every time when each event data are written in. Therefore, if an event number is increased or writing timings are delayed due to processes for inputted data or switching operations, a time interval among pre-recorded event information must be extended. As a result, a performance period of whole musical tune must be changed.

In addition, the conventional apparatus does not output the inputted performance information but generates musical tones corresponding to the inputted performance information by an input unit such as a keyboard performance unit in a recording period. Hence, the conventional apparatus can not reproduce the musical tones similar to the recorded musical tones.

Further, when a recording is completed while a player keeps a key depressing in the recording period, the conventional apparatus must keep a musical tone corresponding to the depressed key generating at a time when a performance is completed in a reproducing period. Similarly, when a reproducing is completed while a reproduced musical tone is kept generating, such reproduced musical tone must be kept generating.

SUMMARY OF THE INVENTION

It is accordingly a primary object of the present invention to provide a multi-recording apparatus of an electronic musical instrument in which timings of once written data are not changed even if the event number is increased so that the performance period of whole musical tune can be prevented from being extended.

It is another object of the present invention to provide a digital event type multi-recording apparatus which can simultaneously generate the recording musical tones and the reproduced musical tones in a multi-recording period.

It is still another object of the present invention to provide an event type performance recording and reproducing apparatus which can prevent the musical tones from being kept generating in the case where the recording is stopped while depressing the keys or in the case where the reproducing is stopped while generating the reproduced musical tones.

In a first aspect to the invention, there is provided a multi-recording apparatus of an electronic musical instrument comprising: (a) memory means for recording performance information and generation timing information together, the performance information representing musical tones generated by playing external performance means, the generation timing information representing a generation timing when the performance information is generated; (b) measuring means for measuring a timing when the performance information is newly inputted from the external performance means as first generation timing when the inputted performance information is generated; (c) reproducing control means for reproducing the performance information pre-recorded in the memory means in accordance with the generation timing information; (d) extracting means for extracting second generation timing information from reproduced performance information; and (e) recording control means for simultaneously recording both of the inputted performance information and the reproduced performance information with third generation timing information in the memory means, the third generation timing information for both of the inputted and reproduced performance information being calculated out so that each generation timing information of each reproduced performance information can be equal to the second generation timing information extracted by the extracting means, whereby musical tones newly inputted from the external performance means are over-recorded on a channel pre-recorded with the musical tones in the memory means.

In a second aspect of the invention, there is provided a multi-recording apparatus of an electronic musical instrument comprising: (a) a plurality of input channels each inputting performance information, the performance information being identical to event data representing events of depressed or released keys and generation timings of the events; (b) memory means for recording the inputted performance information by every input channel; (c) setting means for selectively permitting recording and reproducing of each input channel in the memory means, the setting means selectively setting one of a recording mode, a reproducing mode and a stop mode; (d) recording control means for reading first performance information from a first input channel which is permitted to be recorded in accordance with clocks pre-stored in the memory means, the recording control means over-recording the read first performance information with newly inputted second performance information on the first input channel in the recording mode; (e) first output control means for selecting the second performance information from a plurality of inputted performance information and outputting the selected second performance information to be recorded on the first input channel within the plurality of input channels in the recording mode; (f) second output control means for selecting third performance information from a plurality of performance information read from the memory means, the selected third performance information being outputted with respect to a second input channel which is permitted to be recorded or reproduced in the recording or reproducing mode; (g) a plurality of output channels; and (h) selecting means for selecting the output channel corresponding to the first or second input channel, the selecting means outputting the performance information of each input channel outputted from each of the first and second output control means to the selected output channel.

In a third aspect of the invention, there is provided a multi-recording apparatus of an electronic musical instrument comprising: (a) memory means for recording event data as performance information, the event data representing events of depressed or released keys and generation timings of the events; (b) setting means for selectively setting one of a recording mode, a reproducing mode and a stop mode at least; (c) first storing means for storing first information representative of depressing states of keys which are designated by the performance data inputted from external performance means; (d) recording control means for recording the inputted performance information in the memory means in the recording mode, the recording control means detecting depressed keys based on contents of the first information stored in the first storing means so as to generate and record first releasing information of the depressed keys in the memory means when the recording mode is changed to the stop mode; (e) reading means for reading the performance data from the memory means in accordance with clocks; (f) second storing means for storing second information representative of the depressing states designated by the read performance information; and (g) output control means for outputting the read performance information in the recording and reproducing modes, the output control means detecting depressing keys based on contents of the second information stored in the second storing means so as to generate and output second releasing information of the depressed keys when the recording or reproducing mode is changed to the stop mode.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIG. 27 is a diagram for explaining an operation example of the multi-recording apparatus shown in FIG. 1.

DESCRIPTION OF THE PREFERRED EMBODIMENT

Figure 1:
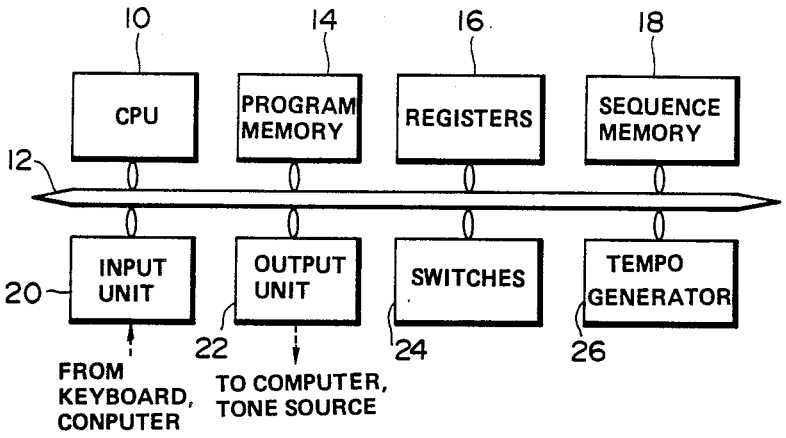
FIG. 1 is a block diagram showing a hardware construction of an embodiment of the multi-recording apparatus of an electronic musical instrument.

Referring now to the drawings, wherein like reference characters designate like or corresponding parts throughout the several views, FIG. 1 is a block diagram showing a hardware construction of an embodiment of the multi-recording apparatus of an electronic musical instrument.

[A] Diagrammatical Description of Multi-Recording Apparatus Shown in FIG. 1

This multi-recording apparatus shown in FIG. 1 (hereinafter, referred simply to as "this apparatus") is a so-called event type recording apparatus which records key-event data and timing data together. The key event data represents depressing and releasing of keys in the keyboard of the electronic musical instrument, and the timing data represents timings (or time intervals) for generating the key events. Thereafter, this apparatus reproduces the musical tones from the recorded key event data based on the time intervals represented by the timing data so as to output such reproduced musical tones. In this case, the recording is performed based on the key event data inputted from performance information generating means such as the keyboard and the computer. In addition, the reproduced key event data are transferred to the computer, a tone source and the like. Further, this apparatus can combine the input data and the reproduced data together so as to generate new recording data and then record such new recording data on an original track (or a channel) from which the reproducing data are read.

This apparatus provides eight input terminals for inputting the key event data and eight output terminals for outputting the key event data. Each terminal provides sixteen channels each according to a Musical Instrument Digital Interface (MIDI) standard. Hereinafter, such channel will be referred to as a MIDI channel. Therefore, this apparatus provides $8\times16=128$ input channels and 128 output channels. Hence, it is possible to simultaneously connect 128 input units (such as the keyboards of the electronic musical instruments) and 128 output units (such as tone sources of the electronic musical instruments) to this apparatus.

In addition, sixty four recording tracks are provided, and each track can be assigned with desirable one input channel and one output channel. Each track can be recorded with data representative of thirty two keys which are simultaneously depressed.

As described heretofore, this apparatus can be normally connected with 128 equivalent musical instruments, and then this apparatus can select sixty four equivalent musical instruments from 128 equivalent musical instruments so as to record and reproduce the performance played by use of the selected sixty four equivalent musical instrument. Within a capacity limit of the tone sources connected to the output terminals of this apparatus, it is possible to simultaneously generate thirty two reproduced tones by each track, i.e., it is possible to simultaneously generate $32\times64=2048$ reproduced tones as a whole of this apparatus.

[B] Description of Construction of Multi-Recording Apparatus Shown in FIG. 1

In FIG. 1, a central processing unit (CPU) 10 is provided in order to control operations of the whole multi-recording apparatus. This CPU 10 is connected with a program memory 14, registers 16, a sequence memory 18, an input unit 20, an output unit 22, switches 24 and a tempo generator 26 via a bidirectional bus line 12.

The program memory 14 is constructed by a read only memory (ROM) and the like, and this program memory 14 pre-store control programs for controlling the CPU 10.

The registers 16 temporarily stores several data which are generated when the CPU 10 executes the above-mentioned control programs. Each of the registers 16 is arranged at a predetermined area within a random access memory (RAM).

The registers 16 provided in this multi-recording apparatus can be described in an alphabet order as follows. In the following thirty one registers, each numeral designates each register and contents of data thereof.

1. CSX: CSX represents a X-coordinate of a cursor for designating a register TBL (0 to 63, 1 to 5) constituting input/output information tables (shown in FIGS. 6A to 6C), and this X-coordinate corresponds to a recording track No.
2. CSY: CSY represents a Y-coordinate of a cursor for designating a register TBL (0 to 63, 1 to 5), and this Y-coordinate corresponds to input/output information.
3. FLG: FLG represents a flag for discriminating a sequence data process.
4. IN1 to IN3: IN1 to IN3 represent input data buffers each storing input data (or key codes) from the input unit.
5. IKCBUF (0 to 63, 0 to 31): IKCBUF represents an input key code buffer for storing the depressed key information at the input terminal by each track.
6. INCH: INCH represents MIDI channels (0 to 15) of the input data.
7. INTRM: INTRM represents input terminal information (0 to 7) of the input data.
8. i: i represents a control variable.
9. j: j represents another control variable.
10. JOB: JOB represents a performance mode (0: STOP, 1: PLAY, 2: RECORD).
11. KC: KC represents the key code (of 7 bits).
12. LEN: LEN represents a time interval of the event.
13. LNREST: LNREST represents a remained time of the time interval LEN to be written in.
14. LNSAM: LNSAM an lapsed time which is lapsed after the preceding key event is generated.
15. OKCBUF (0 to 63, 0 to 31): OKCBUF represents an output key code buffer for storing depressed key information at the output terminal by each track.
16. OLDRCNT: OLDRCNT represents old data of a RECCNT (i.e., a write timing register).
17. OUT1 to OUT3: OUT1 to OUT3 represent output data buffers each outputting data to the output unit.
18. OUTCH: OUTCH represents the MIDI channel (0 to 15) of the output data.
19. OUTTRM: OUTTRM represents output terminal information (0 to 7) of the output data.
20. PIRQMSK: PIRQMSK represents a masking of a reproducing interrupt signal PLAYIRQ (1: mask, 0: interrupt is permitted).
21. RD1 to RD3:RD1 to RD3 represent buffers for the event data read from an internal memory.
22. RECCNT: RECCNT represents a count value of a count timer RECTIMER (shown in FIG. 5) for writing the inputted performance information.
23. RPT: RPT represents a pointer for reading the sequence data, and this pointer will be referred to as a reading pointer hereinafter.
24. SONGEND: SONGEND represents the last address of sequence performance data.
25. SONGTOP: SONGTOP represents the head address of the sequence performance data.
26. TBL (0 to 63, 0 to 31): TBL represents a register for setting the input/output states of each track.
27. TCH: TCH represents a touch information of the inputted key data.
28. TRKIN: TRKIN represents a track number as the input data.
29. TRKRD: TRKRD represents a track number as internal memory data.

30. TRKWT: TRKWT represents a track number to be newly written in.

31. WPT: WPT represents a pointer for writing the sequence data, and this pointer will be referred to as a writing pointer hereinafter.

Figures 6A, 6B, 6C, 7:
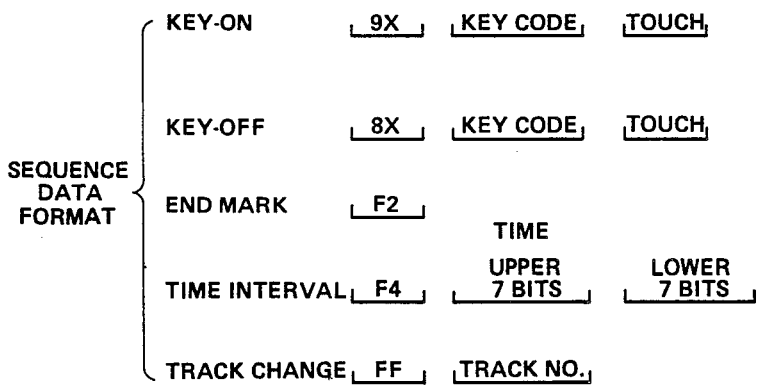
FIGS. 6A to 6C are tables for explaining input and output states of the embodiment shown in FIG. 1.
FIG. 7 shows an example of a sequence data format.

The sequence memory 18 is constructed by the RAM so as to record the performance information such as the key codes, for example. As shown in FIG. 7, this sequence memory 18 stores data having a word length of three bytes such as "key-on" data, "key-off" data and "time interval" data; "track change" data having a word length of two bytes; and "end mark" data having a word length of one byte. The first byte within each of the above-mentioned data designates an identifier mark representative of a data kind thereof.

In the identifier marks "9X" and "8X" of the "key-on" and "key-off" data, "X" designates the MIDI channel of such data. In addition, the second byte of each of the "key-on" and "key-off" data designates the "key-code", and the third byte thereof designates the "touch" information.

The "end mark" is one byte data which are not added with a parameter term and which only represent an identifier mark $F2_H$. Hereinafter, data added with the suffix "$_H$" will represent data of hexadecimal digit.

In the "time interval" data, the first byte represents an identifier mark $F4_H$, the second byte represents upper seven bits of the time interval data, and the third byte represents lower seven bits of the time interval data.

In the "track change" data, the first byte represents an identifier mark $FF_H$ and the second byte represents two byte data having track data.

Figure 2:
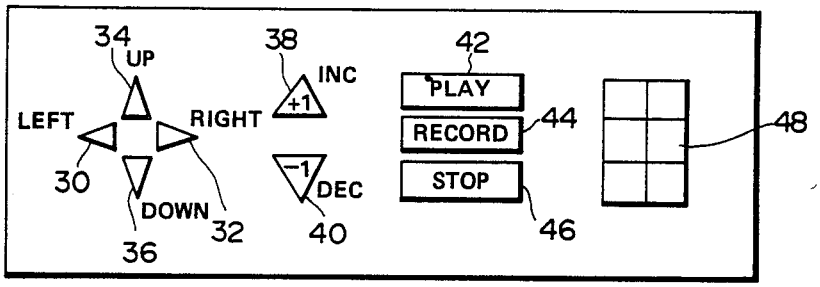
FIG. 2 is a front view showing an appearance of an operation panel.

FIG. 2 is a front view showing an appearance of an operation panel of this multi-recording apparatus. This operation panel shown in FIG. 2 provides switches 30, 32, 34 and 36 for moving a cursor, an increment (INC) switch 38, a decrement (DEC) switch 40, a PLAY switch 42, a RECORD switch 44, a STOP switch 46 and other operating switches 48 including a tempo setting switch. The switches 30, 32, 34 and 36 are provided in order to designate the register TBL (0 to 63, 1 to 5) for setting input/output information of the registers 16. In addition, the INC switch 38 and the DEC switch 40 are provided in order to change data stored in the register TBL (CSX, CSY) designated by the cursors CSX and CSY. Further, the PLAY switch 42, the RECORD switch 44 and the STOP switch 46 are provided in order to select desirable performance mode of this multi-recording apparatus. These switches 30 to 48 constitutes the switches 24 shown in FIG. 1.

Figure 3:
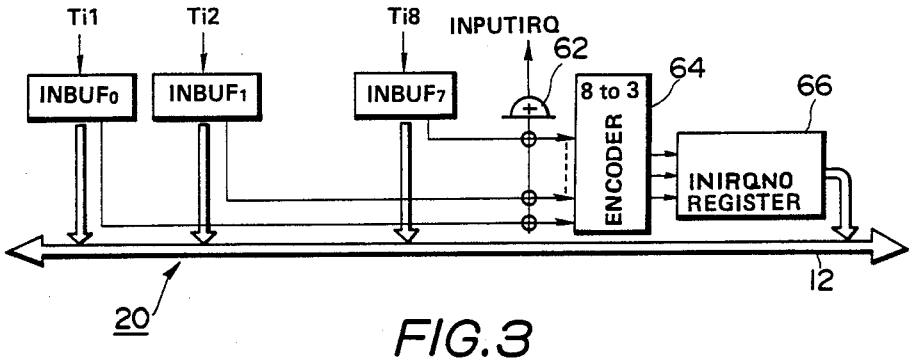
FIG. 3 is a circuit diagram showing an input unit shown in FIG. 1.

As shown in FIG. 3, the input unit 20 shown in FIG. 1 consists of eight input terminals Ti1 to Ti8, input buffers $INBUF_0$ to $INBUF_7$, an OR gate 62, an encoder 64 and input interrupt number (INIRQNO) register 66. The input buffers $INBUF_0$ to $INBUF_7$ are constituted by first-in-first-out (FIFO) registers which temporarily store the performance information inputted via the input terminals Ti1 to Ti8 and then sequentially output each bit data of the performance information in accordance with an inputting order. The OR gate 62 detects the inputted performance information and then generates an input interrupt signal INPUTIRQ when the performance information is inputted via one of the input terminals Ti1 to Ti8. The encoder 64 detects one or some numbers of the input buffers which store the inputted performance information within the input buffers $INBUF_0$ to $INBUF_7$ which are designated by a 3-bit signal to be transmitted to register 66. The register 66 temporarily stores such detected input buffer numbers until the inputted performance information is read out from the input buffers.

Figure 4:
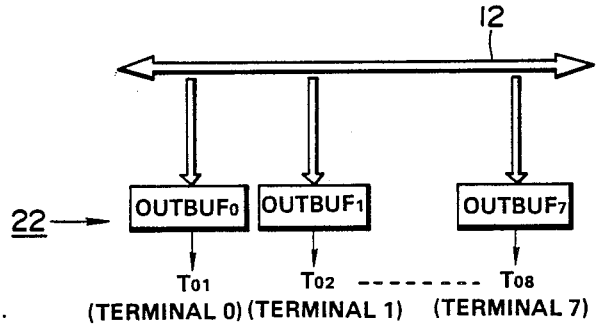
FIG. 4 is a circuit diagram showing an output unit shown in FIG. 1.

As shown in FIG. 4, the output unit 22 provides the bidirectional bus line 12 and output buffers $OUTBUF_0$ to $OUTBUF_7$ connected between the bus line 12 and eight output terminals To1 to To8.

Figure 5:
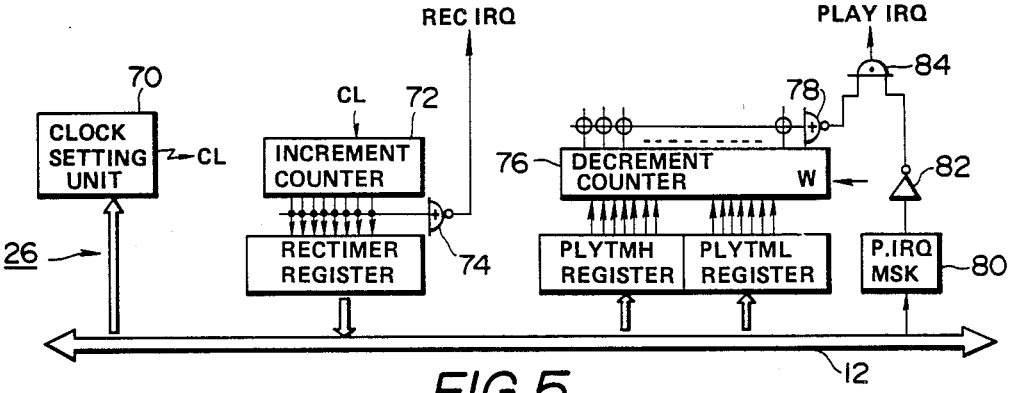
FIG. 5 is a circuit diagram showing a tempo generator shown in FIG. 1.

As shown in FIG. 5, the tempo generator 26 consists of a clock setting unit 70 for generating a clock CL having a frequency corresponding to set tempo value, a 8-bit increment counter 72 for counting the clock CL, a NOR gate 74, a counter timer for the recording (hereinafter, referred to as a recording timer RECTIMER), registers PLYTMH and PLYTML, a decrement counter 76, a NOR gate 78, a register 80, an inverter 82 and an AND gate 84. The NOR gate 74 outputs a recording interrupt signal RECIRQ at every time when the count value of the counter 72 becomes equal to a value "0", i.e., data value ($00_H$). The recording timer RECTIMER latches the count value of the counter 72. When the time interval data are read from the sequence memory 18, such time interval data are divided into upper data of upper seven bits and lower data of lower seven bits. The register PLYTMH stores such upper data, and the register PLYTML stores such lower data. After the registers PLYTMH and PLYTML respectively preset the time interval data, the decrement counter 76 counts down the clock CL. The NOR gate 78 outputs the reproducing interrupt signal PLAYIRQ when the count value of the counter 76 becomes equal to the value "0". The value "1" is set in the register 80 when the reproducing interrupt signal PLAYIRQ is masked in the stop mode. At this time, the inverter 82 and the AND gate 84 inhibits the reproducing interrupt signal PLAYIRQ from being outputted.

FIG. 6A is a diagram showing the register TBL(x, y) for setting the input/output states of the registers 16 as a table. In a first column "TRACK NO." shown in FIG. 6A, the number of the recording tracks which are set in the sequence memory 18 are written, and this "TRACK NO." is indicated by the value of the cursor CSX in an actual process. In a second column "INPUT", the input channels of the data to be recorded on the corresponding tracks are written. Each input channel is selected by the input terminal number (in a column of CSY=1) and the MIDI channel (in a column of CSY=2). In a third column "OUTPUT", the output channels of the data read from the tracks are written. Each output channel is selected by the output terminal number (in a column of CSY=3) and the MIDI channel (in a column of CSY=4). In a fourth column "TRACK MODE" (i.e., in a column of CSY=5), processing contents of the tracks are written. Next, FIGS. 6B and 6C shows the processing contents of each track mode.

As shown in FIGS. 6B and 6C, no data are read from and written into the track corresponding to the track mode of "0(stop)", and the input data of such track are not outputted as well. On the other hand, no input data are written into and outputted from the track corresponding to the track mode of "1(play)", but the internal data (i.e., the sequence performance data) corresponding to such track are reproduced and then outputted to the output terminal when the performance mode is set to the reproducing or recording mode (i.e., when JOB equals to "1" or "2"). Next, regardless of the performance mode, the input data of the track corresponding to the track mode of "2(rec)" are outputted to the output terminal. In this case, the input data are written into such track corresponding to the track mode of "2(rec)" when the performance mode is set to the recording mode (i.e., JOB equals to "2"), and the internal data of such track are outputted to the output terminal when the performance mode is set to the reproducing or recording mode (i.e., JOB equals to "1" or "2").

[c] Description of Operations of Multi-Recording Apparatus Shown in FIG. 1

Next, description will be given with respect to the operations of the multi-recording apparatus shown in FIG. 1 in conjunction with FIGS. 8 to 27.

(1) Main Process

Figure 8:
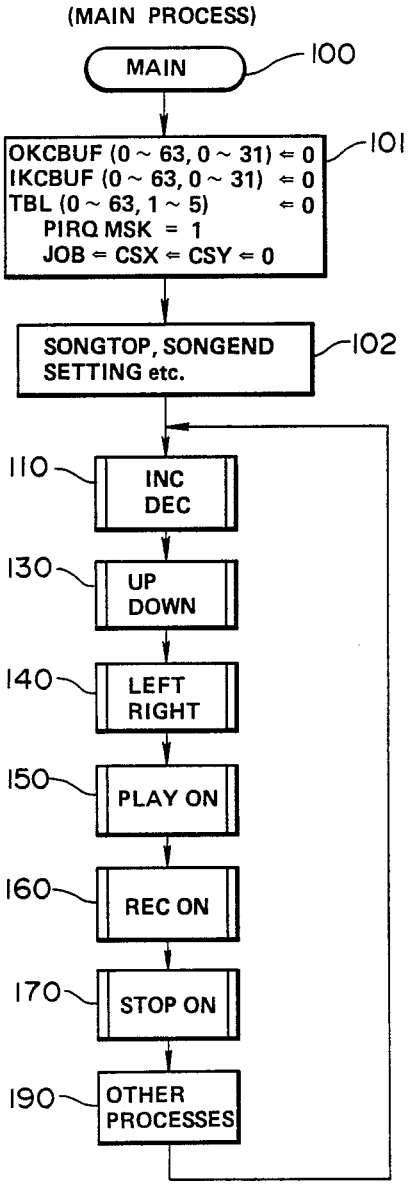
FIG. 8 is a flow chart showing a main process.

First, description will be given with respect to the main process in conjunction with FIG. 8. In a first step 100 of the main process shown in FIG. 8, the CPU 10 starts to operate in accordance with the control programs stored in the program memory 12. In next steps 101 and 102, the CPU 10 initializes the registers 16. More specifically, in the step 101, the CPU 10 sets the output key code buffer OKCBUF (0 to 63, 0 to 31), the register TBL (0 to 63, 0 to 31) for setting the input/output states and a reproducing interrupt masking register PIRQMSK, and the CPU 10 also clears the performance mode register JOB. In this case, it is possible to set a predetermined preset value (read from the ROM or an external memory) to these registers. In the step 102, the external memory and the like set the head address SONGTOP and the last address SONGEND of the sequence performance data.

After the above-mentioned initialization, the CPU 10 calls and executes each subroutine of an INC/DEC switching process (in a step 110), an UP/DOWN switching process (in a step 130), a LEFT/RIGHT switching process (in a step 140), a PLAY switch-on process (in a step 150), a REC switch-on process (in a step 160) and a STOP switch-on process (in a step 170), and then the CPU 10 executes the other processes (in a step 190). Thereafter, the CPU 10 repeatedly executes the series of the processes in the above-mentioned steps 110 to 190.

(2) INC/DEC Switching Process

The INC switch 38 and the DEC switch 40 shown in FIG. 2 are used for changing the input/output states of the register TBL (csx, csy).

Figure 9:
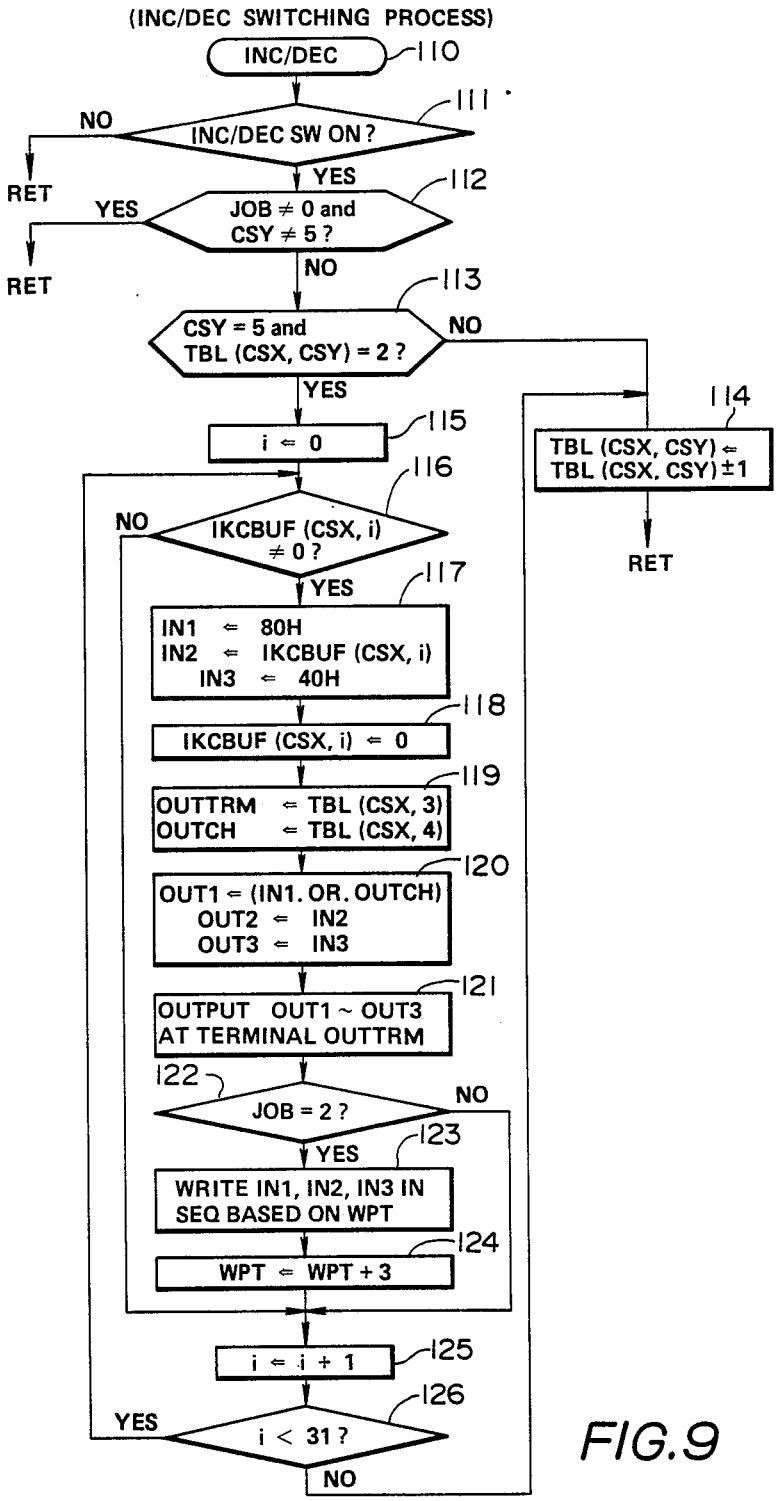
FIG. 9 is a flow chart showing an INC/DEC switching process.

Next, description will be given with respect to the INC/DEC switching process in conjunction with FIG. 9. In a step 111 shown in FIG. 9, the CPU 10 checks whether either the INC switch 38 or the DEC switch 40 is turned on or not. When neither switch 38 or 40 are turned on in the step 111, the present process returns to the main process (shown in FIG. 8). On the other hand, when one of these switches 38 and 40 is turned on, the present process advances to a next step 112 wherein the CPU 10 checks the values of the performance mode register JOB and the cursor Y-coordinate CSY. When the performance mode indicates the modes other than the stop mode (i.e., JOB does not equal to "0") and the cursor designates the modes other than the track mode (i.e., CSY does not equal to "5"), the present process returns to the main process (shown in FIG. 8). Thus, the input/output channels are inhibited from being changed in the reproducing or recording cycle.

If the performance mode is set to the stop mode (i.e., the value of the register JOB equals to "0") and the cursor designates the track mode (i.e., CSY equals to "5"), the present process advances to a next step 113 wherein the CPU 10 checks the contents of the cursor Y-coordinate CSY and the input/output information stored in the register TBL(csx, csy). In the case where the cursor designates the track mode (i.e., CSY=5) and the cursor X-coordinate CSX designates the recording mode (i.e., TBL(csx, 5)=2), the present process advances to a step 115. In other cases, the present process advances to a step 114. When the INC switch 38 is turned on, the content of the input/output information stored in the register TBL(csx, csy) (hereinafter, simply referred to as content or value of the register TBL(csx, csy)) is increased in the step 114. However, when the DEC switch 40 is turned on, the content of the register TBL(csx, csy) is decreased in the step 114. After executing the process in the step 114, the present process will return to the main process.

Incidentally, in the step 114, the value of the register TBL(csx, csy) is increased or decreased in the following ranges in accordance with the value of CSY:

(i) in between values 0 and 7 when CSY equals to 1 or 3;

(ii) in a range between values 0 and 15 when CSY equals to 2 or 4; and (iii) in a range between values 0 and 2 when CSY equals to 5.

When the value of the register TBL(csx, 5)=2 is increased, the value thereof will be increased to "0", for example.

Meanwhile, the case where CSY=5 and TBL(csx, 5)=2 in the step 113 is identical to the case where the track mode of the track having the track number CSX (hereinafter, simply referred to as the track CSX) is changed from the recording mode to the other modes by turning the switch 38 or 40 on. In this case, if there is a key depressed while the switch 38 or 40 is turned on, the key-off process is executed on such depressed key in steps 115 to 126.

More specifically, the value "0" is set to the control variable i in the step 115, and then the CPU 10 checks whether the key code is stored in the input key code buffer IKCBUF(csx, i) of the track CSX or not. If the key code is not stored in the input key code buffer IKCBUF(csx, i), the processes in the steps 117 to 124 are not executed but the present process directly advances to the step 125.

Meanwhile, if the key code is stored in the input key code buffer IKCBUF(csx, i), the key-off data of such stored key code are set to the input data buffers IN1 to IN3 in the step 117, and then the CPU 10 clears the buffer IKCBUF(csx, i) in the step 118. In the above step 117, data of $40_H$ are normally set to the input data buffer IN3 as touch information of the key-off. In a next step 119, the CPU 10 reads out data representative of the output terminal of the track CSX and data representative of the MIDI channel from the input/output information register TBL, and then the CPU 10 transfers such two data to the output terminal register OUTTRM and the output channel register OUTCH respectively. Thereafter, the key-off data stored in the input data buffers IN1 to IN3 are converted into data OUTCH only having the MIDI channel data, and then such converted data OUTCH are stored in the output data buffers OUT1 to OUT3 in the step 120. After the output data stored in the output data buffers OUT1 to OUT3 are outputted to the output terminal register OUTTRM in the step 121, the CPU 10 confirms the performance mode in the step 122. When the performance mode is the recording mode (i.e., JOB=2), the key-off data set in the input data buffers IN1 to IN3 are written into the sequence memory 18 under the designation of the writing pointer in the step 123. Thereafter, the value of the writing pointer is counted up by "3" in the step 124, and then the present process advances to the next step 125. On the other hand, when the performance mode is not identical to the recording mode in the step 122, the processes in the steps 123 and 124 are skipped and the present process directly advances to the step 125.

In the step 125, the control variable i is increased by one. In the next step 126, the CPU 10 judges whether the value of the control variable i is increased over a value "31" or not. If the value of the control variable i is below the value "31", the present process returns to the step wherein the key-off process is executed on the next key code buffer IKCBUF(csx, i). On the other hand, if the value of the control variable i is over the value "31", the CPU 10 completes the checking operations and the key-off processes of all input key code buffers in the corresponding track. Hence, the present process advances to the step 114 wherein the value of the register TBL(csx, csy) is increased or decreased when the switch 38 or 40 is turned on as described before. Thereafter, the present process returns to the main process (shown in FIG. 8) again.

(3) UP/DOWN Switching Process

The UP switch 34 and the DOWN switch 36 (shown in FIG. 2) are provided for moving the cursor X-coordinate CSX up and down on the input/output state table shown in FIG. 6A.

Figure 10:
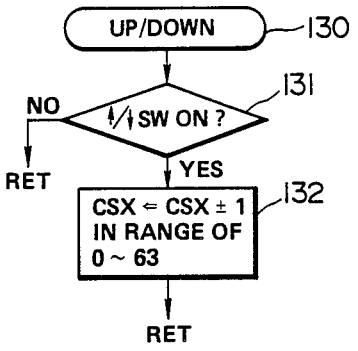
FIG. 10 is a flow chart showing an UP/DOWN switching process.

In FIG. 10, a step 131 checks the UP switch 34 and the DOWN switch 36. In a next step 132, the value of the cursor X-coordinate CSX is increased or decreased in a value range between 0 to 63 when either the switch 34 or 36 is turned on. On the other hand, when either the switch 34 or 36 is not turned on, the present process directly returns to the main process (shown in FIG. 8) from the step 131.

(4) LEFT/RIGHT Switching Process

The LEFT switch 30 and the RIGHT switch 32 (shown in FIG. 2) are provided for moving the cursor Y-coordinate CSY right and left on the input/output state table shown in FIG. 6A.

Figure 11:
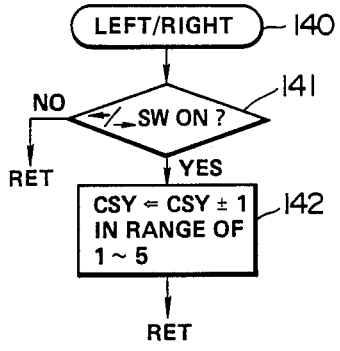
FIG. 11 is a chart showing a LEFT/RIGHT switching process.

In FIG. 11, the CPU 10 checks the LEFT switch 30 and the RIGHT switch 32 in a step 141. When tee switch 30 or 32 is turned on, the value of the cursor Y-coordinate CSY is increased or decreased in a value range between 1 to 5 in a step 142. On the other hand, when either the switch 30 or 32 is not turned on, the present process directly returns to the main process (shown in FIG. 8) from the step 141.

(5) PLAY Switch-On Process

Figure 12:
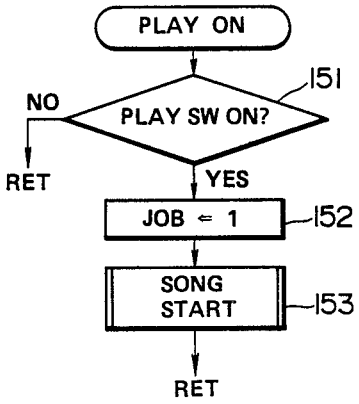
FIG. 12 is a flow chart showing a PLAY switch-on process.

In FIG. 12, the CPU 10 judges whether the PLAY switch 42 is turned on or not in a step 151. If the PLAY switch 42 is not turned on, the present process directly returns to the main process (shown in FIG. 8). If the PLAY switch 42 is turned on, the present process advances to a next step 152 wherein the value "1" is set to the performance mode register JOB. In a next step 153, the CPU 10 executes a song start process of a step 200 (which will be described in FIG. 14). Thereafter, the present process returns to the main process again.

(6) REC Switch-On Process

Figure 13:
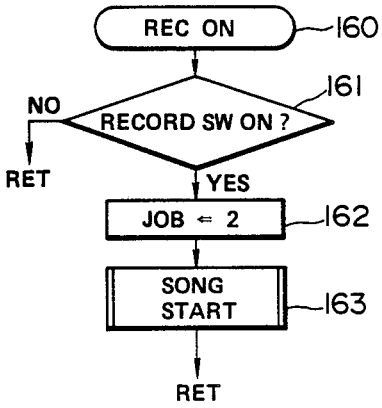
FIG. 13 is a flow chart showing a REC switch-on process.

In FIG. 13, the CPU 10 judges whether the RECORD switch 44 is turned on or not in a step 161. If the RECORD switch 44 is not turned on, the present process directly returns to the main process. If the RECORD switch 44 is turned on, the present process advances to a next step 162 wherein the value "2" is set to the performance mode register JOB. In a next step 163, the CPU 10 executes the song start process of the step 200 shown in FIG. 14. Thereafter, the present process returns to the main process again.

(7) SONG START Process

When the PLAY switch 42 or the RECORD switch 44 is turned on, the value "1" or "2" is set to the performance mode register JOB. Thereafter, the song start process of the step 200 will be executed. In such song start process, the registers used for the reproducing and the recording are preset at first, and thereafter, the identifier mark at the first byte of the sequence performance data is read from the sequence memory 18. Based on such read identifier mark, the CPU 10 reads several data such as the key-on data, the key-off data, the track change data, the time interval data and the end mark data, and then the CPU 10 executes the processes based on such read data. The above data reading operation of the CPU 10 is repeatedly executed until the time interval data or the end mark data are read.

Next, description will be given with respect to the song start process in conjunction with FIG. 14. In a step 201 shown in FIG. 14, the reading pointer RPT is preset to the head address SONGTOP of the sequence performance data, and the writing pointer WPT is preset to an address next to the last address SONGEND of the sequence performance data. At this time, the value of the writing pointer WPT is stored as a new head address of the sequence performance data. Further, the CPU 10 clears the reproducing interrupt mask PIRQMSK to thereby enable the reproducing interrupt PLAYIRQ in a step 202. In a step 203, the output value of the recording timer RECTIMER (shown in FIG. 5) is stored in the recording time register RECCNT. In a step 204, the CPU 10 clears the lapsed time register LNSAM.

Next, the CPU 10 reads one byte data the address of which is designated by the reading pointer RPT, and then such read one byte data are stored in the flag FLG in a step 205. In this case, the identifier mark representing the data kind thereof is positioned at the first byte of the sequence performance data stored in the sequence memory 18 as shown in FIG. 7. In a step 206, the CPU 10 judges the contents of data stored in the flag FLG. Based on such judgment result, the present process selectively branches to one of the data reading processes of the track change data (in a step 210), the key-on event data (in a step 220), the key-off event data (in a step 240), the time interval data (in a step 260) and the end mark data (in a step 270). After executing each of the data reading processes of the track change data (in the step 210), the key-on event data (in the step 220) and the key-off event data (in the step 240) and other processes (in a step 280), the present process returns to the step 205 wherein the next data reading process is executed. On the other hand, after executing each of the data reading processes of the time interval data (in the step 260) and the end mark data (in the step 270), the present process returns to the main process (shown in FIG. 8) again.

(8) TRACK CHANGE PROCESS

The head data of the sequence performance data are normally set by track change data ($FF_H$).

Figure 14:
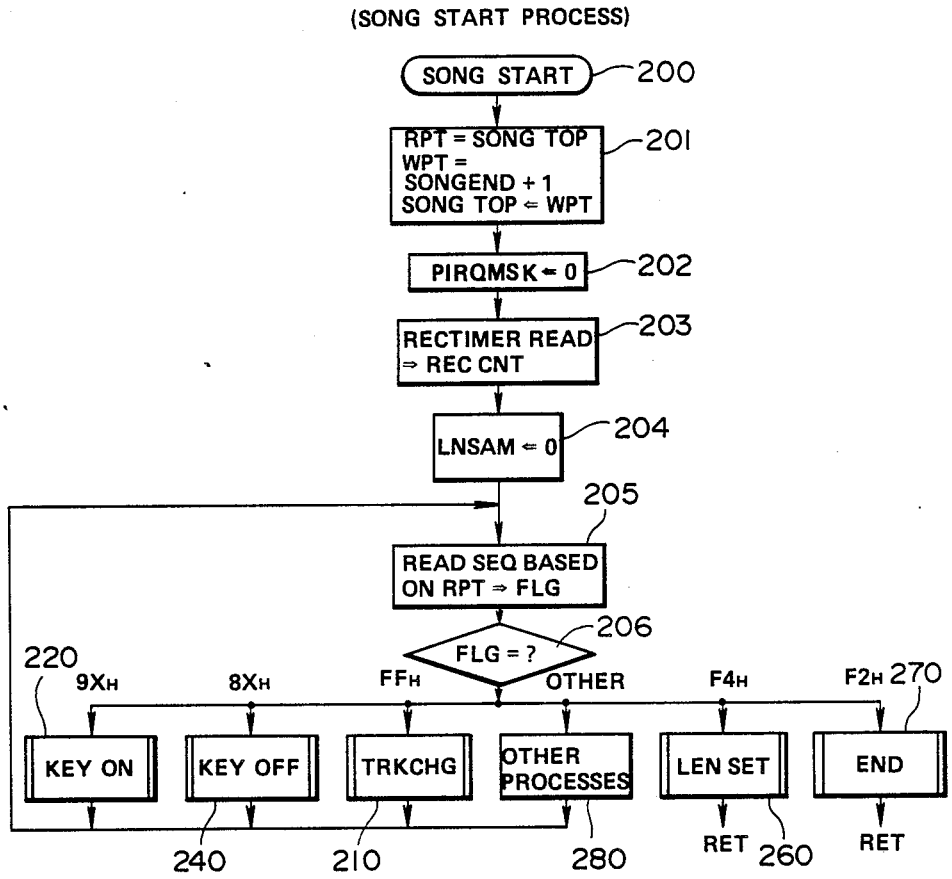
FIG. 14 is a flow chart showing a song start process.
Figure 15:
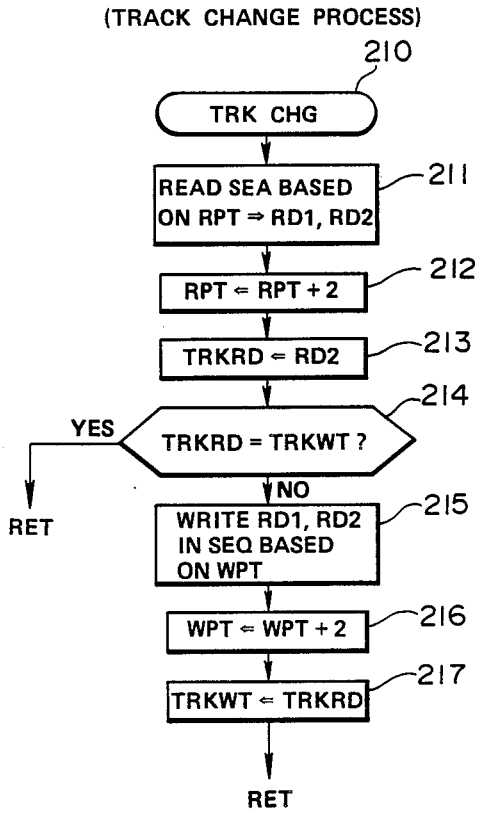
FIG. 15 is a flow chart showing a track change process.
Figure 23:
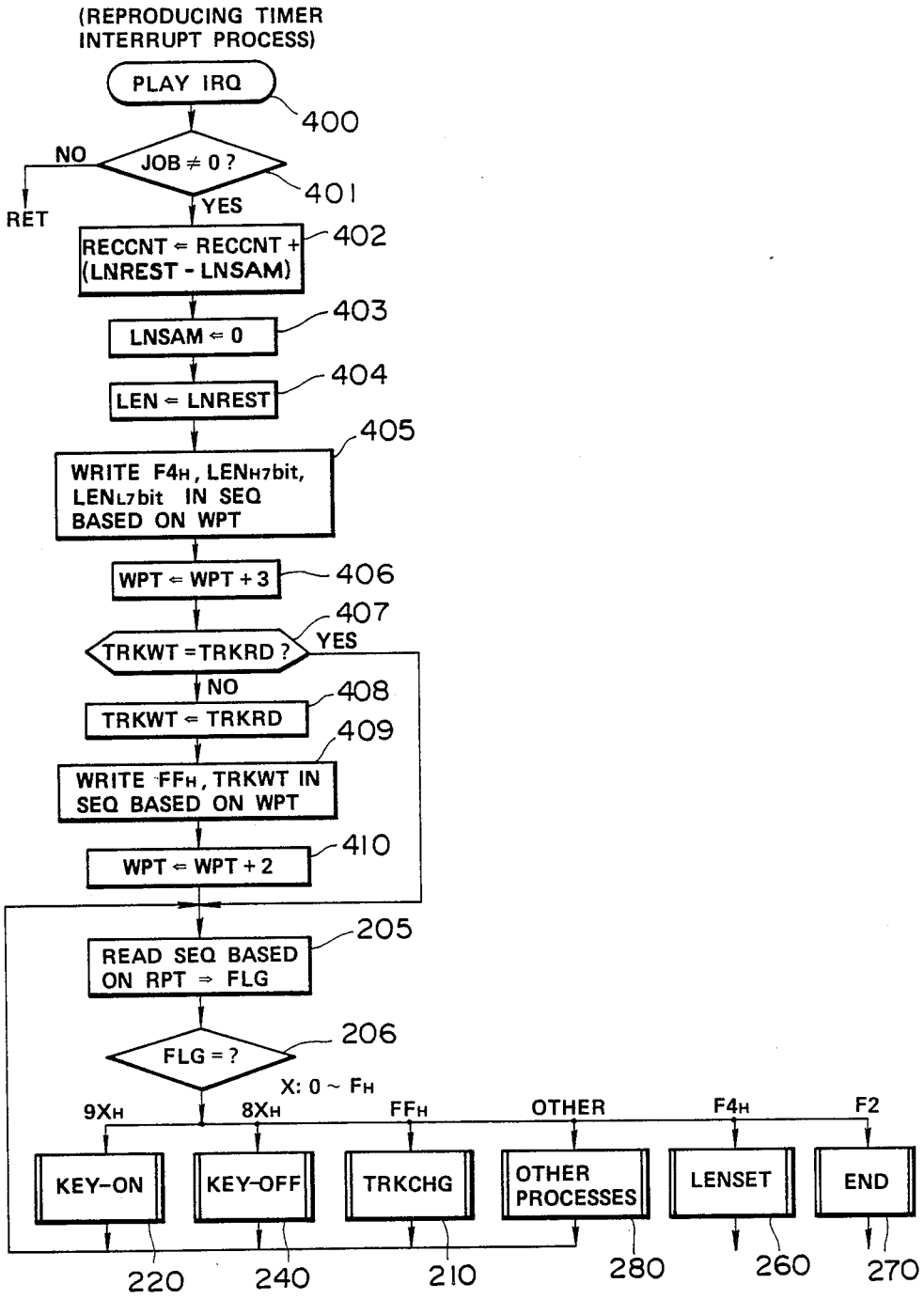
FIG. 23 is a flow chart showing a reproducing timer interrupt process.

In the step 206 shown in FIGS. 14 and 23, if the CPU 10 judges that the identifier mark is represented by the data $FF_H$, the CPU 10 executes the track change process in the step 210 shown in FIG. 15.

In FIG. 15, based on the address pointed by the reading pointer RPT, the track change data of two bytes are read from the sequence memory 18. First and second bytes of the track change data are respectively stored in the reading data buffers RD1 and RD2, and the reading pointer RPT is counted up by two so that the next reading address will be designated in steps 211 and 212. After the track number in the buffer RD2 is store in the track number register TRKRD, the present reading track stored in the register TRKRD (hereinafter, simply referred to as the present reading track TRKRD) is compared with the writing track TRKWT (in steps 213 and 214). If the present reading track TRKRD is identical to the writing track TRKWT, the present process returns to the step 205 (shown in FIGS. 14 and 23). If the present reading track TRKRD is not identical to the writing track TRKWT, the track change data of two bytes stored in the buffers RD1 and RD2 are written in the sequence memory 18 based on the address designated by the writing pointer WPT (in a step 215), and the writing pointer WPT is counted up by two (in a step 216) so that the next writing address will be designated. Next, the writing track number TRKWT is changed to a number TRKRD in a step 217. Thereafter, the present process returns to the original step 205 (shown in FIGS. 14 and 23).

(9) Key-On Event Process

Figure 16:
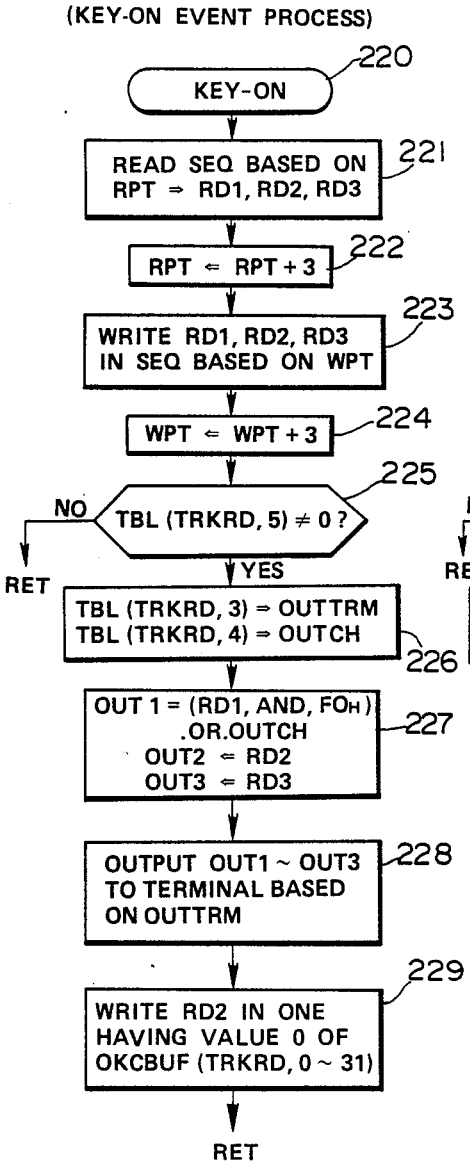
FIG. 16 is a flow chart showing a key-on event process.

If an identifier mark $9X_H$ is stored in the flag FLG in the step 206 shown in FIGS. 14 and 23, the CPU 10 executes the key-on event process of the step 220 shown in FIG. 16.

In FIG. 16, based on the value of the reading pointer RPT, key-on data of three bytes are read from the sequence memory 18. Each one byte of such read key-on data is stored in each of the reading data buffers RD1 to RD3, and then the reading pointer RPT is counted up by three in steps 221 and 222. Next, based on the value of the writing pointer WPT, the key-on data read from the buffers RD1 to RD3 are written into the sequence memory 18 in a step 223. After the pointer WPT is counted up by three so that the next writing address will be designated, the CPU 10 judges whether the track mode TBL(TRKRD, 5) of the present reading track is the stop mode or not in steps 224 and 225. If the track mode is the stop mode, the processes of the following steps 226 to 229 will be unnecessary. Hence, the present process returns to the original step 205 shown in FIGS. 14 and 23.

In the reproducing or recording cycle, the CPU 10 reads the output terminal data TBL(TRKRD, 3) and the output MIDI channel TBL(TRKRD, 4) to which the data read from the buffers RD1 to RD3 are to be outputted from the input/output information register. Such read output terminal data and the output MIDI channel are respectively stored in the registers OUTTRM and OUTCH in a step 226. Next, new key-on data are produced by replacing the input MIDI channel $X_H$ by the output MIDI channel stored in the register OUTCH within the key-on data read from the buffers RD1 to RD3, and such new key-on data are stored in the output data buffers OUT1 to OUT3, the output data of which are transmitted to the output terminal register OUTTRM in steps 227 and 228.

Further, the key code stored in the buffer RD2 (=OUT2) is written into the idle buffers within the output key code buffers OKCBUF(TRKRD, 0 to 31) in a step 229. Thereafter, the present process returns to the original step 205 shown in FIGS. 14 and 23.

(10) Key-Off Event Process

Figure 17:
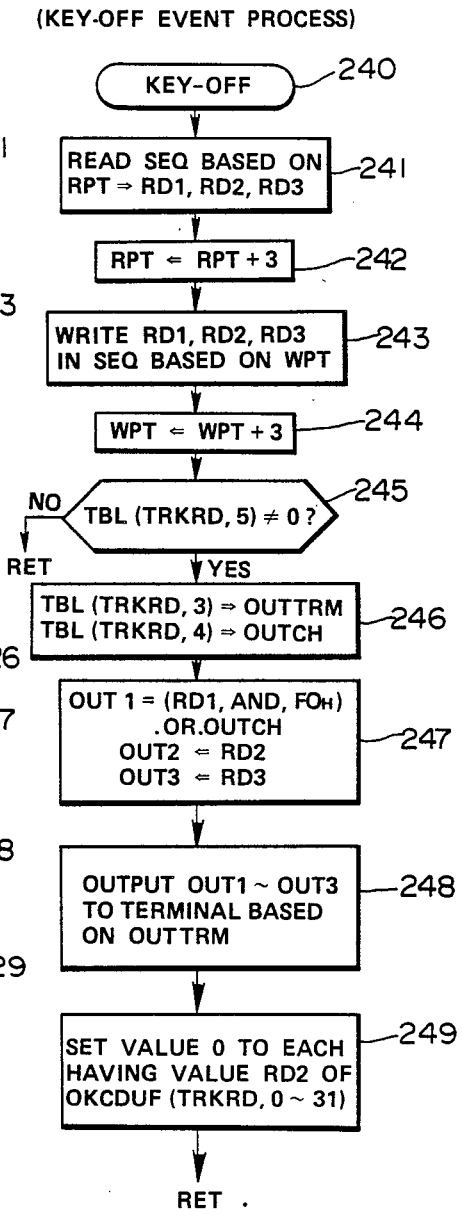
FIG. 17 is a flow chart showing a key-off event process.

In the step 206 shown in FIGS. 14 and 23, an identifier mark $8X_H$ is stored in the flag FLG, the CPU 10 executes the key-off event process of the step 240 shown in FIG. 17.

In FIG. 17, the procedures in steps 241 to 248 are similar to those in the steps 221 to 228 shown in FIG. 16, except that the key-off event data are processed instead of the key-on event data, hence, description thereof will be omitted. In a step 249, the CPU 10 clears the buffers written with the key code stored in the buffer RD2(=OUT2) within the output key code buffers OKCBUF(TRKRD, 0 to 31). Thereafter, the present process returns to the original step 205 shown in FIGS. 14 and 23.

(11) TIME INTERVAL DATA PROCESS

Figure 18:
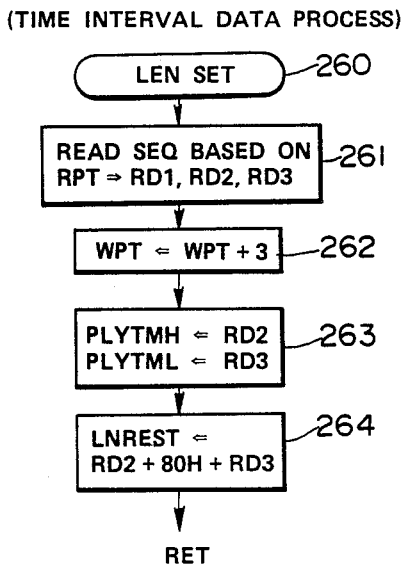
FIG. 18 is a flow chart showing a time interval data process.

If an identifier mark $F4_H$ is stored in the flag FLG in the step 206 shown in FIGS. 14 and 23, the CPU 10 executes the time interval process of the step 260 shown in FIG. 18.

In FIG. 18, the time interval data of three bytes are read out based on the value of the reading pointer RPT, and then each one byte of the read time interval data is stored in each of the reading data buffers RD1 to RD3 in a step 261. In a next step 262, the value of the reading pointer RPT is counted up by three so that the next reading address will be designated. The read time intervals stored in the buffers RD2 and RD3 are respectively set to the reproducing timer registers PLYTMH and PLYTML (shown in FIG. 5) in a step 263. Such time intervals stored in the buffers RD2 and RD3 are represented by two byte data, one byte of which consists of seven bits. Such two byte data are converted into data of fourteen bits, which are stored in the remaining time register LNREST in a step 264. Thereafter, the present process returns to the original step 205 shown in FIGS. 14 and 23.

(12) End Mark Process

If data $F2_H$ are read as the identifier mark in the step 205 shown in FIGS. 14 and 23, the present process advances to the end mark process (shown in FIG. 19) via the step 206. The end mark is represented by one byte data.

Figure 19:
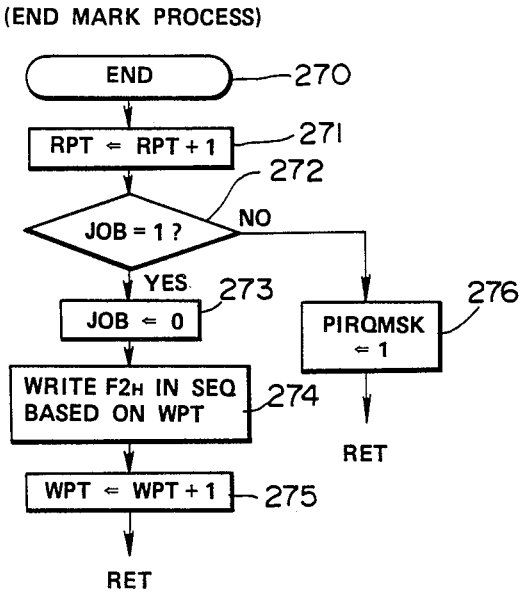
FIG. 19 is a flow chart showing an end mark process.

In FIG. 19, the reading pointer RPT is counted up by one so that the next reading address will be designated in a step 271, and the CPU 10 judges whether the performance mode designates the reproducing (i.e., JOB=1) or not in a step 272. If the performance mode designates the reproducing, the performance mode is set to the stop mode (i.e., JOB=0) in a step 273. In a next step 274, the end mark $F2_H$ is written into the sequence memory 18 based on the value of the writing pointer WPT. After the writing pointer WPT is counted up by one so that the next writing address will be designated in a step 275, the present process returns to the original step 205 shown in FIGS. 14 and 23.

In the case where the performance mode does not designate the reproducing but the recording in the step 272, the value "1" is set to the reproducing interrupt mask register PIRQMSK so as to inhibit the reproducing interrupt (i.e., the reading of the sequence performance data) from being executed in a step 276. Thereafter, the present process returns to the original step 205 shown in FIGS. 14 and 23. When the performance mode designates the recording, the reproducing is only inhibited from being executed so that the recording will be continuously executed until the STOP switch 46 (shown in FIG. 2) is turned on.

(13) STOP Switch-On Process (Part I)

Figure 20:
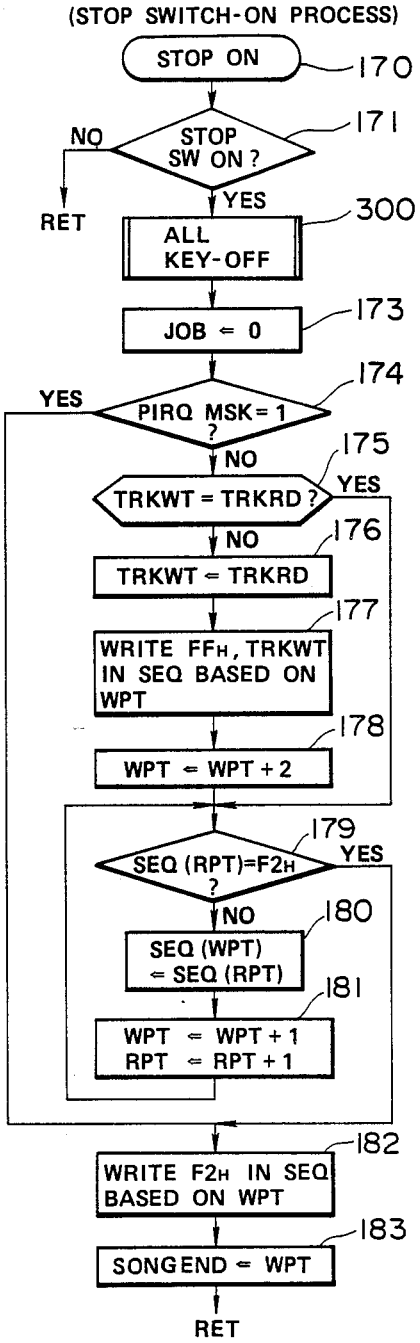
FIG. 20 is a flow chart showing a STOP switch-on process.

In FIG. 20, the CPU 10 judges whether the STOP switch 46 (shown in FIG. 2) is turned on or not in a step 171. If the STOP switch 46 is not turned on, the present process directly returns to the main process. On the other hand, if the STOP switch 46 is turned on, the CPU 10 executes the all key-off process of a step 300 shown in FIG. 21.

(14) All Key-Off Process

In this all key-off process the key-off process is executed on the key code corresponding to the reproduced musical tone which is generated when the STOP switch 46 is turned on in the reproducing or recording mode. As described before, each of the sixty four tracks provides thirty two output key code buffers. Hence, the CPU 10 scans all of 2048 (=64×32) output key code buffers so as to search the output key code buffers storing th key codes. Then, the CPU 10 executes the key-off process on the key codes stored in such searched output key code buffers. Since no inputted musical tone and no reproduced musical tone is generated by the track having the track mode "0", such track does not store the key code the musical tone of which is generated. Hence, the CPU 10 detects the track having the track mode "0" in a step 302. By skipping the scanning on such track, the processing time can be shortened.

Figure 21:
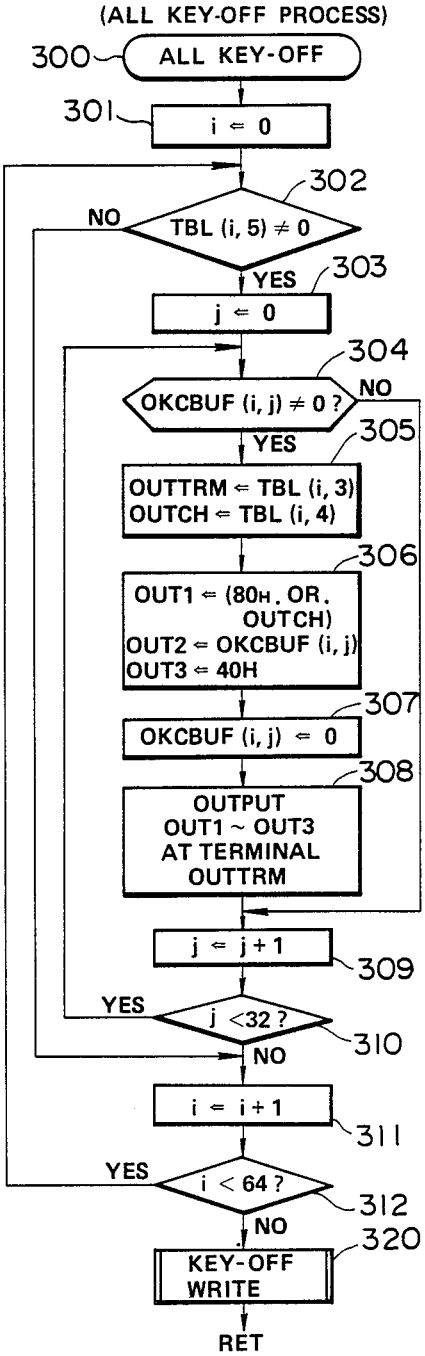
FIG. 21 is a flow chart showing a all key-off process.

In FIG. 21, the value "0" is set to the control variable for designating the track in a step 301, and the CPU 10 checks the track mode TBL(i, 5) of the track having the track number i (hereinafter, simply referred to as the track i) in a step 302. When the performance mode designates the reproducing or the recording other than the stop mode, the value "0" is set to a control variable j for designating the buffer in a step 303, and the CPU 10 judges whether the key code is stored in the output key code buffer OKCBUF(i, j) or not in a step 304. If the key code is stored in the buffer OKCBUF(i, j), the CPU 10 reads out output terminal data TBL(i, 3) and output MIDI channel TBL(i, 4) of the track i which are respectively stored in the registers OUTTRM and OUTCH in a step 305. In a next step 306, the CPU 10 produces key-off data having an output MIDI channel stored in the register OUTCH and a key code OKCBUF(i, j), and such key-off data are stored in the output data buffers OUT1 to OUT3. Further, the CPU 10 clears the buffer OKCBUF(i, j) in a step 307, and the key-off data stored in the buffers OUT1 to OUT3 are transferred to the output terminal register OUTTRM in a step 308. Thereafter, the control variable j is increased by one in a step 309, and the CPU 10 judges whether the searching is completely executed on all of the output key code buffers of the corresponding track or not in a step 310. If such searching is not completed, the present process returns to the step 304, whereby the searching will be executed on the next output key code buffer of the corresponding track. On the other hand, if the searching is completed, the control variable i is increased by one in a step 311, and then the CPU 10 judges whether the searching is completely executed on all of the sixty four tracks or not in a step 312. If such searching is not completed, the present process returns to the step 302, whereby the key code searching will be repeatedly executed on the next track. On the other hand, if the searching is completed, the CPU 10 executes a key-off write process of a step 320 (shown in FIG. 22). Thereafter, the present process advances to a step 173 in the STOP switch-on process (shown in FIG. 20).

(15) Key-Off Write Process

If there is a key the key-on data of which are only written in the sequence memory 18 but the key-off data of which have not been written in the sequence memory 18 yet (i.e., if there is a key which is depressed but not released), the key-off write process is executed when the STOP switch 46 (shown in FIG. 2) is turned on in the recording mode. More specifically, in the key-off write process, the key-off data of such depressing key are generated and then written in the sequence memory 18. More concretely, the CPU 10 scans the 2048 input key code buffers in order to search the input key code buffers which store the key codes. With respect to such key codes, the key-off data are generated and then written in the sequence memory 18.

Figure 22:
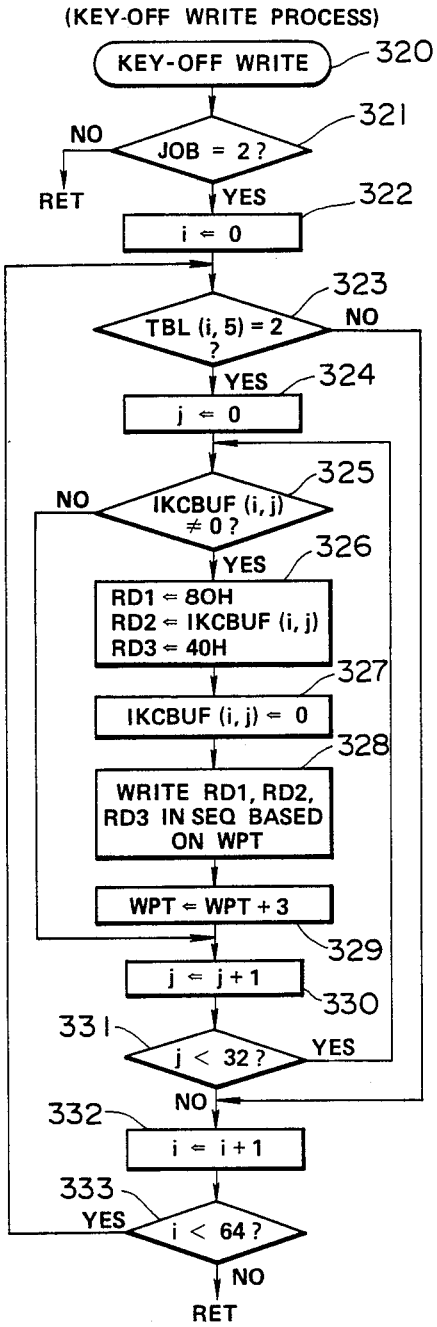
FIG. 22 is a flow chart showing a key-off write process.

In FIG. 22, the CPU 10 checks the value of the performance mode JOB in a step 31. This key-off write process is necessary only in the recording mode (i.e., JOB=2). Hence, if the performance mode is not the recording mode, the present process in the step 321 returns to the all key-off process (shown in FIG. 21). If the performance mode is the recording mode, the value "0" is set to the control variable i in a step 322, and the CPU 10 judges whether the track mode TBL(i, 5) of the track i is set to the recording mode or not in a step 323. If such track mode is not the recording mode, there are no keys depressed for writing the key-on and key-off data, so that the processes in steps 324 to 331 are skipped and then the present process advances to a step 332 from the step 323. If such track mode is the recording mode, the value "0" is set to the control variable j in the step 324, and the CPU 10 judges whether the key code is stored in the input key code buffer IKCBUF(i, j) or not in the step 325. If the key code is not stored in such input key code buffer, the processes in the steps 326 to 329 are skipped and then the present process advances to the step 330 from the step 325. If the key code is stored in such input key code buffer, the key-off data of such key code is produced and then stored in the reading data buffers RD1 to RD3 in the step 326. In the next step 327, the CPU 10 clears the buffer IKCBUF(i, j). Based on the value of the writing pointer WPT, such key-off data stored in the buffers RD1 to RD3 are written into the sequence memory 18. Then, the writing pointer WPT is counted up by three so that the next writing address will be designated in the step 329. Thereafter, the control variable j is increased by one in the step 330, and the CPU 10 judges whether the searching is completely executed on all buffers of the track i or not in the step 331. If there remain the buffers which are not searched, the present process returns to the step 325 wherein the CPU 10 judges whether the key code is stored in the next buffer IKCBUF(i, j) or not. Meanwhile, if the searching is completely executed on all of the thirty two buffers of the track i, the present process advances to the next step 332 wherein the control variable i is increased by one. Next, the CPU 10 judges whether the searching is completely executed on the depressing keys in all of the sixty four tracks and whether the key-off data are completely written with respect to such searched keys or not in the step 333. If the CPU 10 judges that the searching and the key-off data writing are not completed, the present process returns to the step 323, whereby the above-mentioned processes in the steps 324 to 332 are repeatedly executed. If the CPU 10 judges that the searching and the key-off data writing is completed, the present process returns to the all key-off process (shown in FIG. 21) and further returns to the STOP switch-on process (shown in FIG. 20).

(16) STOP Switch-On-Process (Part II)

In FIG. 20, the value "0" is set to the performance mode register JOB in a step 173. In a next step 174, the CPU checks whether the value of the reproducing interrupt mask register PIRQMSK equals to the value "1" or not. If such value equals to "1", the sequence performance data are reproduced and then completely transferred to a new performance data area before the STOP switch 46 is turned on (as shown in the step 276 of FIG. 19). If such value equals to "0", there remain the sequence performance data which have not been transferred to the new performance data area yet. In this case, the remained sequence performance data are added to the last of the new sequence performance data.

More specifically, the writing track number TRKWT is compared with the reading track number TRKRD in a step 175. If these two track numbers are different to each other, the track change data (of two bytes) for the reading track are written in the sequence memory 18 based on the value of the writing pointer WPT in steps 176 to 177. After the pointer WPT is counted up by two so that the next writing address is designated in a step 178, the present process advances to a step 179. On the other hand, if the writing track number TRKWT coincides with the reading track number TRKRD, the present process directly advances to the step 179 from the step 175.

Thereafter, until the end mark $F2_H$ is read from the address designated by the reading pointer RPT within the sequence memory 18 in the step 179, data stored in the old performance data area having an address designated by the reading pointer RPT are repeatedly transferred to the new performance data area having an address designated by the writing pointer WPT inq steps 180 and 181. If the end mark is detected in the step 179, the present process advances to a step 182 wherein such end mark $F2_H$ is written in the sequence memory 18 based on the value of the writing pointer WPT. After the last address WPT of the sequence performance data is written in the register SONGEND in a next step 183, the present process returns to the main process (shown in FIG. 8).

(17) Reproducing Timer Interrupt Process

In the reproducing or recording mode of the multi-recording apparatus shown in FIG. 1, the time interval data read from the sequence memory 18 are preset in the decrement counter 76 (shown in FIG. 5) within the tempo generator 26 in the step 263 shown in FIG. 18. When the decrement counter 76 counts down the clock CL so that the count value thereof becomes equal to $0_H$, the tempo generator 26 generates the reproducing interrupt signal PLAYIRQ. Based on such reproducing interrupt signal PLAYIRQ, the CPU 10 executes the reproducing timer interrupt process of the step 400 (shown in FIG. 23). Thus, the event data are read by every time interval (or every event timing) stored in the sequence memory 18 in the multi-recording apparatus according to the present embodiment.

More specifically, the CPU 10 discriminates the performance mode JOB in a step 401 shown in FIG. 23. In the stop mode, the performance mode is not read out. Hence, if the performance mode is the stop mode (i.e., JOB=0), the interrupt process is released and then the present process returns to the original process. On the other hand, if the performance mode is identical to one of the modes other than the stop mode (i.e., JOB does not equal to 0), a value of (LNREST−LNSAM) is added to the value of the writing timing register RECCNT. In this case, the value of LNREST represents the remained time after inputting the key event data of the time interval LEN which are read out in the preceding reproducing interrupt if the key event data are inputted at a timing between the preceding reproducing interrupt and the present reproducing interrupt at the recording (i.e.. JOB=2). The value of LNSAM represents the lapsed time after inputting such key event data.

Next, the CPU 10 clears the register LNSAM in a step 403, and then the remained time LNREST is set to the time interval register LEN in a step 404. Thereafter, time interval data of three bytes are written into the sequence memory 18 based on the value of the writing pointer WPT in a step 405. Such time interval data consist of the identifier mark $F4_H$, data $LEN_{H7bit}$ representative of the upper seven bits of the register LEN and data $LEN_{L7bit}$ representative of the lower seven bits of the register LEN. Further, the pointer WPT is counted up by three so that the next writing address will be designated in a step 406.

In a next step 407, the writing track number TRKWT is compared with the reading track number TRKRD. If these two track numbers are different to each other, the writing track number is changed to thereby coincide with the reading track number. More specifically, the reading track number TRKRD is stored in the register TRKWT in a step 408, and the sequence memory 18 is written by track change data of two bytes consisting of the identifier mark $FF_H$ and a new track number stored in the register TRKWT in a step 409. Thereafter, the pointer WPT is counted up by two so that the next writing address will be designated in a step 410. If the writing track number is identical to the reading track number in the step 407, the processes in the steps 408 to 410 are skipped.

Next, the CPU 10 reads out the event data at the present timing, the time interval data until the next event or the end mark in the next steps. However, the processes in these next steps in the reproducing timer interrupt process shown in FIG. 23 are identical to those in the song start process shown in FIG. 14, hence, description thereof will be omitted.

(18) Recording Timer Interrupt Process

Figure 24:
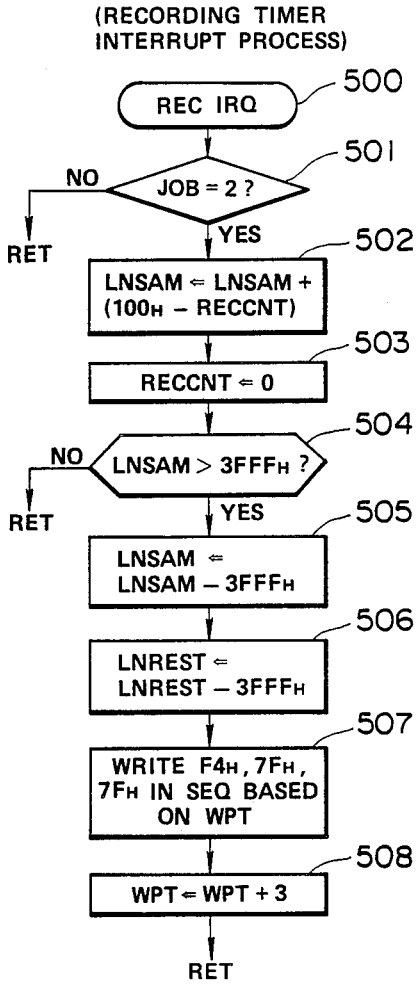
FIG. 24 is a flow chart showing a recording timer interrupt process.

In the multi-recording apparatus shown in FIG. 1, the following interrupt process of a step 500 shown in FIG. 24 is executed based on the recording interrupt signal RECIRQ generated at every time when the increment counter 72 (shown in FIG. 5) within the tempo generator 26 count 256 pulses of the clock CL.

In FIG. 24, the CPU 10 checks the performance mode JOB in a step 501. The recording timer interrupt is necessary only in the recording mode. Hence, if the performance mode is not the recording mode (i.e., JOB does not equal to 2), the recording timer interrupt is immediately released. On the other hand, if the performance mode is the recording mode, the register LNSAM stores the lapsed time which is lapsed after inputting the preceding key event data in a step 502. In other words, the register LNSAM stores the above lapsed time at every time when the increment counter 72 (show in FIG. 5) overflows. Within ($100_H$−RECCNT) of the step 502, the term RECCNT is used for calculating a time until the increment counter 72 overflows at first after inputting the key event data.

After such calculation, the term RECCNT is cleared in a step 503.

In a next step 504, the CPU 10 judges whether the lapsed time stored in the register LNSAM exceeds over data value of $3FFF_H$ or not. In this case, the decrement counter 76 (shown in FIG. 5) for measuring the time interval is constructed by a 14-bit counter in the multi-recording apparatus according to the present embodiment. Hence, in the case where the time interval exceeds over the data value of $3FFF_H$ (i.e., the maximum value of the 14-bit data), such time interval is divided into a plurality of time interval data each having a value smaller than the data value of $3FFF_H$. When the lapsed time stored in the register LNSAM is smaller data value of $3FFF_H$, the interrupt is directly released. On the other hand, if the lapsed time exceeds over the data value of $3FFF_H$, the data value of $3FFF_H$ is subtracted from each of values stored in the registers LNSAM and LNREST in steps 505 and 506. In a next step 507, the sequence memory 18 is written by data of three bytes representative of the time interval $3FFF_H$ based on the value of the pointer WPT. Such data of three bytes consist of $F4_H$, $7F_H$ and $7F_H$. Finally, the writing pointer WPT is counted up by three so that the next writing address will be designated in a step 508, and then the present process returns to the original process.

(19) Input Interrupt Process (Part I)

When the key event data are inputted to one of the input terminals Ti1 to Ti8 of the input unit 20 (shown in FIG. 3) within the multi-recording apparatus shown in FIG. 1, such inputted key event data are stored in the input data registers INBUF0 to INBUF7, and the OR gate 62 generates the interrupt signal INPUTIRQ. The CPU 10 executes the input interrupt process of a step 600 based on this interrupt signal INPUTIRQ.

Figure 25A:
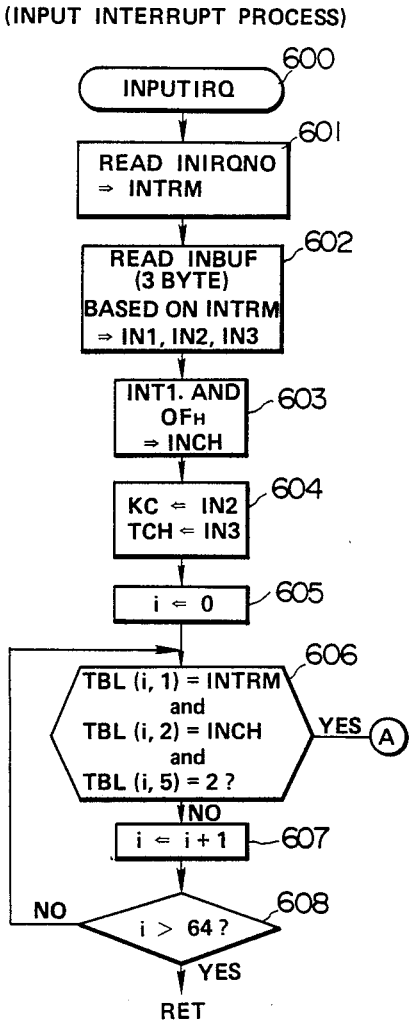
FIGS. 25A to 25C are flow charts showing an input interrupt process.

In FIG. 25A, the CPU 10 reads out the input terminal number n the input terminal of which is inputted with data from the input interrupt number register INIRQNO, and such read input terminal number n is stored in the input terminal register INTRM in a step 601. Next, the CPU 10 output key event data of three bytes from the register INBUFn, and each one byte of such key event data is stored in each of the buffers IN1 to IN3 in a step 602. Further, the MIDI channel included in the identifier mark stored in the buffer IN1 is stored in the register INCH, the key code store in the buffer IN2 is stored in the register KC, and the touch information stored in the buffer IN3 is stored in the register TCH respectively in steps 603 and 604. Thereafter, the CPU 10 scans the input/output state tables shown in FIGS. 6A to 6C so as to search certain recording tracks within the recording tracks having the track number 0 to 63. In each of such certain recording tracks, the input terminal TBL(i, 1) and the MIDI channel TBL(i, 2) must coincide with the values of the registers INTRM and INCH, and the track mode TBL(I, 5) must coincide with the recording mode (i.e., TBL(i, 5)=2). In this case, the recording tracks are searched from the track number 0. When the CPU 10 finds out the recording track having the above-mentioned condition, the present process advances to a step 611 (shown in FIG. 25B) from the step 606.

In the step 611, the detected track number i is stored in the register TRKIN. Next, the CPU 10 reads out and stores the output terminal TBL(TRKIN, 3) and the output MIDI channel TBL(TRKIN, 4) of the above track i in the registers OUTTRM and OUTCH respectively in a step 612. After the MIDI channels of the input data stored in the buffers IN1 to IN3 are changed in the register OUTCH, the output data stored in the buffers OUT1 to OUT3 are produced in a step 613. After such output data are transferred to the output terminal register OUTTRM, the CPU 10 executes the input key code (buffer) process (shown in FIG. 26) in a step 620.

(20) Input Key Code Buffer Process

Figure 25B:
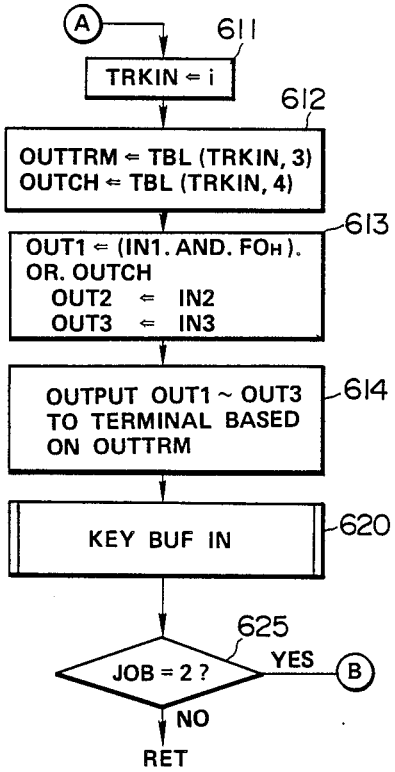
Figure 25C:
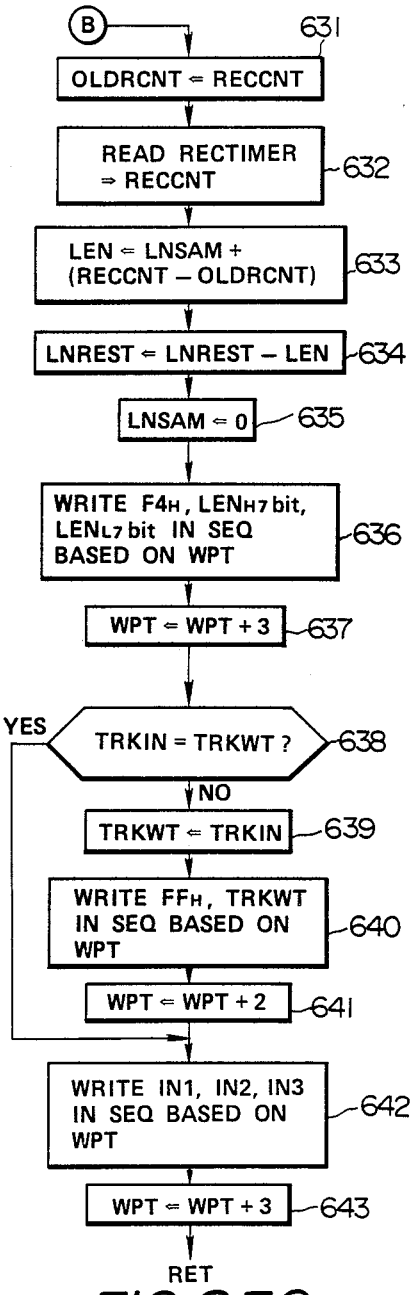
Figure 26:
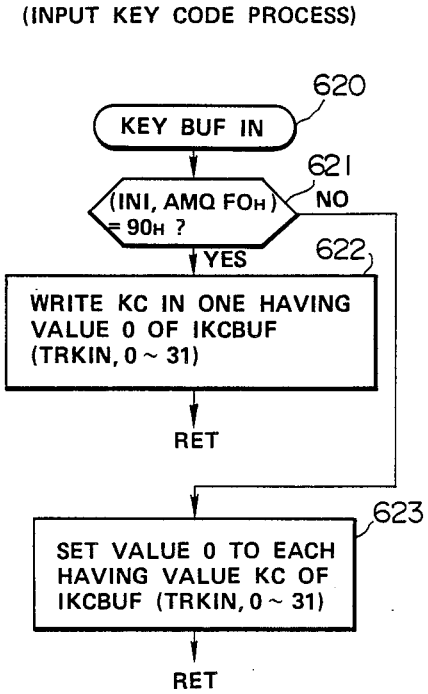
FIG. 26 is a flow chart showing an input key code process.

In FIG. 26, the CPU 10 judges whether the input data are identical to the key-on event data or the key-off event data in a step 621. If the input data are the key-on event data, the key code KC(=IN2) is written into the idle buffers within the thirty two buffers of the track TRKIN in a step 622. Thereafter, the present process returns to the original process in the step 625 shown in FIG. 25B. If the input data are the key-off event data, the CPU 10 clears the buffers storing the key code KC within the thirty two buffers of the track TRKIN in a step 623. Thereafter, the present process returns to the original process in the step 625 shown in FIG. 25B.

(21) Input Interrupt Process (Part II)

In FIG. 25B, the CPU 10 confirms the performance mode JOB in the step 625. The input data are written only in the recording mode (i.e., JOB=2). Hence, if the performance mode is not the recording mode, the CPU 10 immediately releases the interrupt, and the present process returns to the original process. Meanwhile, if the performance mode is the recording mode, the present process advances to a step 631 (shown in FIG. 25C) wherein the writing timing of the preceding key event data stored in the register RECCNT is written into the register OLDRCNT. Thereafter, the register RECCNT is written by the present time represented by the writing counter timer RECTIMER (shown in FIG. 5) in a step 632. Next the CPU 10 calculates out and stores a value of [LNSAM+(RECCNT−OLDRCNT)] in the time interval register LEN in step 633. In addition, the CPU 10 calculates out and stores a value of (LNREST−LEN) in the remained time register LNREST in a step 634. Then, the CPU 10 clears the register LNSAM in a step 635. Further, the CPU 10 writes the time interval data of three bytes into the sequence memory 18 based on the value of the writing pointer WPT in a step 636. Next, the pointer WPT is counted up by three so that the next data writing address will be designated in a step 637. In a next step 638, the writing track number TRKIN of the input data is compared with the present writing track number TRKWT.

If the writing track number TRKIN of the input data is different from the present writing track number TRKWT, the writing track number TRKWT is changed identical to the writing track number TRKIN in a step 639. In a step 640, track change data of two bytes (consisting of data values of $FF_H$ and TRKWT) are written into the sequence memory 18 based on the value of the writing pointer WPT. In a next step 641, the pointer WPT is counted up by two so that the next writing address will be designated. Meanwhile, if the writing track number TRKIN is identical to the present writing track number TRKIN, the processes in the steps 639 to 641 will be skip. Therefore, after the step 638, the present process advances to a step 642 wherein the input data of three bytes stored in the buffers IN1 to IN3 are written into the sequence memory 18 based on the value of the writing pointer WPT. Thereafter, the pointer WPT is counted up by three so that the next writing address will be designated in a step 643. Then, the CPU 10 releases the interrupt, and the present process will return to the original process.

(22) Operation Example of Multi-Recording

FIG. 27 shows an operation example of the multi-recording according to the present embodiment. As shown in FIG. 27, the input data consisting of key event data $K_A$ and $K_B$ are mixed with reproduced data (i.e., old sequence data (a)) consisting of key event data $K_1$, $K_2$, $K_3$ and $K_4$ so as to produce new sequence data (b), and such new sequence data are multi-recorded. Such operation shown in FIG. 27 will be described by indicating the variation of the data stored in several registers.

(a) Recording Start Process & Process of Key Event Data $K_1$

When the RECORD switch 44 is turned on, the present process advances to the song start process (shown in FIG. 14) via the record switch-on process (shown in FIG. 13). In the song start process, the value "0" of the writing timer RECTIMER is stored in the writing timing register RECCNT in the step 203, and the CPU 10 clears the lapsed time register LNSAM in the step 204. Next, the present process advances to the key-on or key-off event process (shown in FIG. 16 or 17).

In such event process, the key event data $K_1$ are read from the old sequence data area in the step 221, and such key event data $K_1$ are written in the new sequence data area in the step 223. Further, the present process returns to the song start process wherein the present process advances to the time interval data process (shown in FIG. 18), whereby the time interval data having a data value "8" are set to each of the reproducing timer PLAYTIMER which is a register to count the time up to the next event and the remained time register LNREST in the steps 263 and 264. These several processes in the steps described heretofore are executed in an extremely short time, in other words, these several processes are executed almost at the same time. Similarly, the following processes of the key event data are executed in an instant moment.

(b) Process of Key Event Data $K_A$

When the key event data $K_A$ are inputted to sequence memory 18, the CPU 10 executes the input interrupt process (shown in FIG. 25), wherein the key event data $K_A$ are read out in the step 602, and the old data having the value "0" stored in the writing timing register RECCNT are once saved in the old writing timing register OLDRCNT and then renewed by the value "5" of the writing timer RECTIMER in the steps 631 and 632. Further, the CPU 10 calculates out the time interval between the key events $K_1$ to $K_A$ so as to obtain the calculated time interval LEN=LNSAM+(RECCNT−OLDRCNT)=0+(5−0)=5 in the step 633, and the CPU 10 also calculates out the remained time between the key events $K_A$ to $K_2$ so as to obtain the calculated remained time LNREST=old-LNREST−LEN=8−5 =3 in the step 634. After the CPU 10 clears the lapsed time register LNSAM in the step 635, the CPU 10 writes the time interval data LEN and the input key event data $K_A$ into the new sequence data area in the steps 636 and 642.

(c) Process of Key Event Data $K_2$

When the reproducing timer PLAYTIMER counts down the preset value "8" to the value "0", the CPU 10 executes the reproducing interrupt process (shown in FIG. 23 In this process, the value of the writing timing register RECCNT is renewed by old-RECCNT+(LNREST−LNSAM)=5+(3−0)=8 in the step 402; the register LNSAM is cleared in the step 403; the remained time LNREST=3 between the key events $K_A$ and $K_2$ is set as the time interval LEN in the step 404; and the time interval LEN=3 is written into the new data area in the step 405. Thereafter, the present process advances to the key event process (shown in FIG. 16 or 17) wherein the reading and writing of the key event data $K_2$ are executed in the steps 221 and 223. Further, the present process returns to the step 205 (shown in FIG. 23) and then advances to the time interval data process (shown in FIG. 18), wherein the time interval data having the value "5" is set to each of the reproducing timer PLAYTIMER and the remained time register LNREST in the steps 263 and 264.

(d) Process of Key Event Data $K_3$

This process of the key even data $K_3$ is executed similar to the process of the key event data $K_2$ described before. More specifically, the value of the writing timing register RECCNT is renewed by old-RECCNT+(LNREST−LNSAM)=8+(5−0)=13 in the step 402; the register LNSAM is cleared in the step 403; the remained time LNREST=5 between the key events $K_2$ and $K_3$ is set as the time interval LEN in the step 404; and the time interval LEN=5 is written into the new data area in the step 405. Thereafter, the present process advances to the key event process (shown in FIG. 16 or 17) wherein the reading and writing of the key event data $K_3$ are executed in the steps 221 and 223. Further, the present process returns to the step 205 (shown in FIG. 23) and then advances to the time interval data process (shown in FIG. 18), wherein the time interval data having the value "250" is set to each of the reproducing timer PLAYTIMER and the remained time register LNREST in the steps 263 and 264.

(e) Recording Interrupt Process

The recording timer RECTIMER is the self-operating 9-bit counter. When the count value of this counter is increased to "255" and then reset to "0", the CPU 10 executes the recording timer interrupt (shown in FIG. 24). In such process, the lapsed time stored in the register LNSAM is renewed by old-LNSAM+($100_H$−old-RECCNT)=0+(256−13)=243, and then the register RECCNT is cleared.

(f) Process of Key Event Data $K_B$

This process of the key event data $K_B$ is executed similar to the process of the key event data $K_A$ described before More specifically, the key event data $K_B$ are read out in the step 602, and the old data having the value "0" stored in the writing timing register RECCNT are once saved in the old writing timing register OLDRCNT and then renewed by the value "1" of the writing timer RECTIMER in the steps 631 and 632. Further, the CPU 10 calculates out the time interval between the key events $K_3$ to $K_B$ so as to obtain the calculated time interval LEN=LNSAM+(RECCNT−OLDRCNT)=243+(1−0)=244 in the step 633, and the CPU 10 also calculates out the remained time between the key events $K_B$ to $K_4$ so as to obtain the calculated remained time LNREST=old-LNREST−LEN=250−244=6 in the step 634. After the CPU 10 clears the lapsed time register LNSAM in the step 635, the CPU 10 writes the time interval data LEN (=244) and the input key event data $K_B$ into the new sequence data area in the steps 636 and 642.

(g) Process of Key Event Data $K_4$

This process of the key event data $K_4$ is executed similar to the process of the key event data $K_3$ described before. More specifically, the value of the writing timing register RECCNT is renewed by old-RECCNT+(LNREST−LNSAM)=1+(6−0)=7 in the step 402; the register LNSAM is cleared in the step 403; the remained time LNREST=6 between the key events $K_3$ *and* $K_4$ is set as the time interval LEN in the step 404; and the time interval LEN=6 is written into the new data area in the step 405. Thereafter, the present process advances to the key event process (shown in FIG. 16 or 17) wherein the reading and writing of the key event data $K_4$ are executed in the steps 221 and 223. Further, the present process returns to the step 205 (shown in FIG. 23) and then advances to the time interval data process (shown in FIG. 18), wherein the time interval data having the value "10" is set to each of the reproducing timer PLAYTIMER and the remained time register LNREST in the steps 263 and 264.

In the present embodiment described heretofore, the timing information is calculated out based on the old timing data when the reproduced musical tones are to be recorded. Hence, it is possible to avoid the extension of the performance time due to the multi-recording which is occurred in the case where the values of the recording timer at the recording are used as the timing data.

Above is description of the preferred embodiment of the present invention. This invention may be practiced or embodied in still other ways without departing from the spirit or essential character thereof. For example, the present embodiment can be modified to the following seven examples.

(i) The sequence memory 18 can be modified to store the sequence data of a plurality of musical tunes.

(ii) As the sequence data, it is possible to employ other event information for changing the tone colors and the like other than the depressing key information.

(iii) The input key code buffers IKCBUF and the output key code buffers OKCBUF can be provided for each terminal or each channel, other than each track.

(iv) The clock CL can be generated in an external clock generator and then supplied to the multi-recording apparatus.

(v) The number of the tracks can be freely selected (vi) The display section can be additionally provided to the multi-recording apparatus in order to display necessary information.

(vii) It is possible to additionally provide an edit function for erasing, copying and correcting etc. with ease.

Therefore, the preferred embodiment described herein is illustrative and not restrictive, the scope of the invention being indicated by the appended claims and all variations which come within the meaning of the claims are intended to be embraced therein.

What is claimed is:

1. A multi-recording apparatus for an electronic musical instrument for providing multi-recording of a newly input performance and a reproduced performance, comprising:

(a) memory means for recording performance information and tone generation timing information together, said performance information representing musical tone generated by playing external performance means, said tone generation timing information representing the tone generation timing when said performance information is generated;

(b) measuring means for measuring a first tone generation timing when newly input performance information is generated by said external performance means;

(c) reproducing control means for reproducing said performance information pre-recorded in said memory means as reproduced performance information in accordance with said tone generation timing information;

(d) extracting means for extracting second tone generation timing information from said reproduced performance information; and (e) recording control means for simultaneously recording both of said newly input performance information and said reproduced performance information along with third tone generation timing information in said memory means, said third tone generation timing information for both of said newly input and reproduced performance information being calculated out to be cumulatively equal to said second tone generation timing information, whereby musical tones newly inputted from said external performance means are over-recorded on a channel pre-recorded with the musical tones in said means.

2. A multi-recording apparatus according to claim 1, wherein said performance information is performance event data of said external performance means.

3. A multi-recording apparatus according to claim 1 or 2, wherein said external performance means is a keyboard of said electronic musical instrument.

4. A multi-recording apparatus according to claim 1 or 2, wherein said external performance means is a computer.

5. A multi-recording apparatus of an electronic musical instrument comprising:

(a) a plurality of input channels each inputting performance information, said performance information comprising event data representing events of depressed or released keys and generation timings of said events;

(b) memory means for recording the inputted performance information for every input channel;

(c) setting means for selectively permitting recording and reproducing of each input channel in said memory means, said setting means selectively setting one of a recording mode, a reproducing mode and a stop mode;

(d) recording control means for reading first performance information from a first input channel which is permitted to be recorded in accordance with clock information pre-stored in said memory means, and for over-recording the read first performance information with newly inputted second performance information on said first input channel when said setting means sets said recording mode;

(e) first output control means for selecting second performance information from a plurality of inputted performance information and outputting the selected second performance information to be recorded on said first input channel within said plurality of input channels in said recording mode;

(f) second output control means for selecting third performance information from a plurality of performance information read from said memory means, the selected third performance information being outputted with respect to a second input channel which is permitted to be recorded or reproduced in said recording or reproducing mode;

(g) a plurality of output channels; and (h) selecting means for selecting said output channel corresponding to said first or second input channel, said selecting means outputting said performance information of each input channel outputted from each of said first and second output control means to the selected output channel.

6. A multi-recording apparatus according to claim 5, wherein said inputted performance information is supplied from a keyboard of said electronic musical instrument.

7. A multi-recording apparatus according to claim 5, wherein said inputted performance information is supplied from a computer.

8. A multi-recording apparatus of an electronic musical instrument comprising:

(a) memory means for recording event data as performance information, said event data representing events of depressed or released keys and generation timings of said events;

(b) setting means for selectively setting one of a recording mode, a reproducing mode and a stop mode at least;

(c) first storing means for storing first information representative of depressed states of keys which are designated by said performance data inputted from external performance means;

(d) recording control means for recording the inputted performance information in said memory means in said recording mode, said recording control means detecting depressed keys based on contents of said first information stored in said first storing means so as to generate and record first releasing information of said depressed keys in said memory means when said recording mode is changed to said stop mode;

(e) reading means for reading said performance data from said memory means;

(f) second storing means for storing second information representative of the key depression states designated by the read performance information; and (g) output control means for outputting said read performance information in said recording and reproducing modes, said output control means detecting depressed keys based on contents of said second information stored in said second storing means so as to generate and output second releasing information of the depressed keys when said recording or reproducing mode is changed to said stop mode.

9. A multi-recording apparatus according to claim 8, wherein said output control means outputs said inputted performance information, while said output control means detects the depressed keys based on said contents of said first information so as to generate and output said first releasing information when said recording or reproducing mode is changed to said stop mode.

10. A multi-recording apparatus according to claim 8 or 9, wherein said external performance means is a keyboard of said electronic musical instrument.

11. A multi-recording apparatus according to claim 8 or 9, wherein said external performance means is a computer.

* * * * *